US008517899B2

(12) United States Patent
Zhou et al.

(10) Patent No.: US 8,517,899 B2
(45) Date of Patent: Aug. 27, 2013

(54) ERGOMETER FOR SKI TRAINING

(76) Inventors: Yifeng Zhou, Calgary (CA); Grayson Hugh Bourne, Golden Beach, FL (US)

( * ) Notice: Subject to any disclaimer, the term of this patent is extended or adjusted under 35 U.S.C. 154(b) by 0 days.

(21) Appl. No.: 13/520,152

(22) PCT Filed: Dec. 2, 2011

(86) PCT No.: PCT/US2011/063083

§ 371 (c)(1),
(2), (4) Date: Jun. 29, 2012

(65) Prior Publication Data

US 2012/0277068 A1 Nov. 1, 2012

Related U.S. Application Data

(60) Provisional application No. 61/418,974, filed on Dec. 2, 2010.

(51) Int. Cl.

| | |
|---|---|
| ***A63B 22/00*** | (2006.01) |
| ***A63B 71/00*** | (2006.01) |
| ***A63B 69/10*** | (2006.01) |
| ***A63B 69/18*** | (2006.01) |
| ***A63B 69/06*** | (2006.01) |
| ***A63B 21/00*** | (2006.01) |

(52) U.S. Cl.
USPC ..... 482/71; 482/51; 482/56; 482/72; 482/138

(58) Field of Classification Search
USPC ..... 482/51–56, 62, 70–73, 92, 110, 114–120, 482/133, 135–138
See application file for complete search history.

(56) References Cited

U.S. PATENT DOCUMENTS

| | | | | |
|---|---|---|---|---|
| 770,994 | A | 9/1904 | White | |
| 4,537,396 | A * | 8/1985 | Hooper | 482/8 |
| 4,625,962 | A | 12/1986 | Street | |
| 5,354,251 | A | 10/1994 | Sleamaker | |
| 5,366,426 | A * | 11/1994 | Glavin | 482/56 |
| 5,409,435 | A | 4/1995 | Daniels | |
| 5,989,163 | A * | 11/1999 | Rodgers, Jr. | 482/70 |
| 6,302,829 | B1 | 10/2001 | Schmidt | |
| 6,790,163 | B1 | 9/2004 | Van De Laarschot et al. | |
| 2006/0073944 | A1 * | 4/2006 | Zuckerman | 482/56 |
| 2007/0111864 | A1 | 5/2007 | Schmidt | |
| 2007/0287601 | A1 * | 12/2007 | Burck et al. | 482/54 |
| 2010/0144496 | A1 | 6/2010 | Schmidt | |

FOREIGN PATENT DOCUMENTS

| | | |
|---|---|---|
| WO | 2004-058363 | 7/2004 |

* cited by examiner

*Primary Examiner* — Oren Ginsberg
(74) *Attorney, Agent, or Firm* — The Concept Law Group, P.A.; Scott D. Smiley; Mark C. Johnson

(57) ABSTRACT

A ski-simulation assembly includes a vertical member with a first portion coupled to a base and a second portion extending upwardly from the base, a first cable portion slidably engaged with the vertical member at the second portion of the vertical member, a second cable portion slidably engaged with the vertical member at the second portion of the vertical member, and a resistance-producing assembly physically coupled to the first cable portion and the second cable portion, where the resistance-producing assembly operable to apply a selective resistance to the first cable portion independent of movement of the second cable portion and apply a selective resistance to the second cable portion independent of movement of the first cable portion.

20 Claims, 21 Drawing Sheets

ERGOMETER FOR SKI TRAINING

CROSS-REFERENCE TO RELATED APPLICATIONS

This application claims priority under 35 U.S.C. §.119(e) based on U.S. Provisional Patent Application Ser. No. 61/418,974, filed Dec. 2, 2010, the contents of which are relied upon and incorporated herein by reference in their entirety.

FIELD OF THE INVENTION

The present invention relates generally to exercise machines and, more particularly, relates to a ski training apparatus that provides equal resistance to either one of a user's arms when moved individually or to both arms moving in unison.

BACKGROUND OF THE INVENTION

Each year, millions of people throughout the world participate in the activity of snow skiing. Some participate simply for fun, while others do it for serious sport competition. However, all participants, regardless of their type of skiing or skiing goals, receive the benefit of exercise.

Sometimes, for example, in the summertime, it is not possible or convenient to ski. During these times, and even times when one is able to snow ski, a person may wish to carry out exercises that mimic the movements performed during skiing. At least one machine exists that allows a participant to mimic ski-like movements with their arms. This machine generally consists of a vertical member that supports a pulley at an upper portion thereof and some sort of resistance device attached thereto. In at least one such machine, a cable is attached to the resistance device through the pulley, while handles, which are attached to the ends of the cable, are available to the user of the device. These handles, when in their resting position, are generally positioned at a height above the user's shoulders. To utilize the device, the user grasps one handle in each hand and pulls both handles at the same time in a direction towards the floor. As the user moves the two handles, the resistance device provides a resistance to the cables. The purpose of this exercise is to mimic the ski movement of planting ski poles in the ground and propelling forward by exerting force on the ski-pole handles.

More specifically, when one skis uphill or across country, they often use ski poles, with one pole in each hand. In Nordic or cross-country skiing, where a skier travels not only downhill but also along horizontal or even uphill terrain, ski poles are used to assist the skier in generating the forces necessary to move. As with downhill skiing, when moving up an incline or even along the horizontal portion of the course, skiers often use a "single-pole" propulsion technique, which is more efficient and practical than using both poles at the same time ("double poling"). Therefore, a machine that only exercises both arms simultaneously does not recreate realistic ski-specific movements.

Unfortunately, with the heretofore known devices of this type, both handles must be pulled down at the same time. If only a single one of the two handles is pulled down, the non-pulled the handle will be pulled up and the resistance device will not place a proper resistance on the handle being pulled down, resulting in an improper exercise.

One prior-art device used for ski-movement training provides a set of ski-pole-type elongated elements, each with an end that is held by the user and an opposite end that slides back and forth along a track coupled to the floor. As a user exercises in this device, they swing their arms alternately to mimic the movement of the skier using ski poles. However, this device suffers from the disadvantage of, first, requiring a large footprint on the floor to accommodate the elongated tracks in which the ski-pull-type elongated elements travel. Second, because each of the poles is coupled to the track in which it slides, the user is limited in the height in which the pole can be raised. As is known in the art, under real ski conditions, the skier will often need to raise his ski poles above shoulder height. Also, the user of this device must alternate feet and hands and cannot perform an exercise where both handles are pulled simultaneously.

One ski-training exercise device is disclosed in U.S. Pat. No. 6,302,829 shows an exercise device that features a pair of one-way clutch drums (15*a*, 15*b*) coupled to a shaft (35), each drum being located on an opposing side of a flywheel (17). Importantly, U.S. Pat. No. 6,302,829 features two separate exercise lines (4*a*, 4*b*). When the two exercise lines (4*a*, 4*b*) are pulled, either together or separately, they rotate the one-way clutch drums (15*a*, 15*b*) which, in turn, rotate the shaft (35) and flywheel (17). Use of two separate lines in an arrangement such as that used in U.S. Pat. No. 6,302,829 has a large disadvantage in a "single-pole" exercise, i.e., where only one handle/cable is pulled at a time. Specifically, when the user pulls only one of the exercise lines (e.g., 4*a*), its clutch drum (15*a*) will rotate and its one-way clutch (214*a*) will engage the shaft (35) and cause it to spin along with the flywheel (17). Because the flywheel (17) is a weighted mass, its inertia keeps the shaft (35) spinning after the user has released the first exercise handle. Now, as the user switches hands and pulls on the opposing exercise line (4*b*), because the shaft (35) and flywheel (17) are already spinning at a high rotation rate, the clutch drum (15*b*) and its one-way clutch (214*b*) have nothing to grip until they have reached the speed of the spinning shaft (35). The effect is a dead spot of no resistance on the second exercise line and then a quick jerk as its clutch finally engages with the shaft. The arrangement makes for repeated discontinuous jerky pulls throughout the exercise period.

Thus, a need exists to overcome the problems with the prior art systems, designs, and processes as discussed above.

SUMMARY OF THE INVENTION

The invention provides a ski-movement apparatus that overcomes the hereinafore-mentioned disadvantages of the heretofore-known devices and methods of this general type and that provides a ski-pole mimicking resistance to either arm moving individually or to both arms moving in unison.

With the objects of the invention in view, there is provided A ski-simulation assembly that includes a vertical member with a first portion coupled to a base (or alternatively to a wall or other vertical surface) and a second portion extending upwardly from the base, a first cable portion slidably engaged with the vertical member at the second portion of the vertical member, a second cable portion slidably engaged with the vertical member at the second portion of the vertical member, and a resistance-producing assembly physically coupled to the first cable portion and the second cable portion, where the resistance-producing assembly operable to apply a selective resistance to the first cable portion independent of movement of the second cable portion and apply a selective resistance to the second cable portion independent of movement of the first cable portion.

In accordance with a further feature of the present invention, the resistance-producing assembly includes a flywheel, a shaft, a first engagement member, e.g., a clutch, rotationally coupled to the shaft in a first direction and rotationally disengaged with the shaft in a second direction that is opposite the first direction, and a second engagement member, e.g., a clutch, rotationally coupled to the shaft in the first direction and rotationally disengaged with the shaft in the second direction.

In accordance with another feature, a ski-simulation assembly includes a vertical member having a first portion coupled to a base and a second portion extending upwardly from the base, a first cable portion slidably engaged with the vertical member at the second portion of the vertical member, a second cable portion slidably engaged with the vertical member at the second portion of the vertical member, and a resistance-producing assembly physically coupled to the first cable portion and the second cable portion. The resistance-producing assembly is operable to apply a selective resistance to the first cable portion independent of movement of the second cable portion and apply a selective resistance to the second cable portion independent of movement of the first cable portion.

In accordance with a further feature of the present invention, a first arm is coupled to and extends away from the second portion of the vertical member in a first direction and a second arm is coupled to and extends away from the second portion of the vertical member in a second direction that is substantially opposite the first direction.

In accordance with an additional feature of the present invention, a first pulley is coupled to a distal portion of the first arm and a second pulley is coupled to a distal portion of the second arm, wherein the first cable portion is slidably engaged with the first pulley and the second cable portion is slidably engaged with the second pulley.

In accordance with an additional feature of the present invention, the first arm further comprises a first portion and a second portion slidably coupled to and selectively moveable with relation to the first portion and operable to selectively adjust a distance between the first pulley and the second pulley.

In accordance with a further feature of the present invention, the second portion is slidably coupled to and selectively moveable with relation to the first portion and operable to selectively adjust a distance between the first portion and the first and second arms.

In accordance with another feature, the present invention further includes a first ski-pole handle coupled to a proximal end of the first cable and a second ski-pole handle coupled to a proximal end of the second cable.

In accordance with the present invention, a method of training for skiing includes the steps of grasping a handle coupled to a first cable portion of a ski-simulation assembly, grasping a handle coupled to a second cable portion of a ski-simulation assembly, and alternatively pulling the first cable portion and the second cable portion to cause the resistance-producing assembly to move and generate a resistance in response to either cable being pulled individually. The ski-simulation assembly includes a vertical member having a first portion coupled to a base and a second portion extending upwardly from the base, the first cable portion is slidably engaged with the vertical member at the second portion of the vertical member, a second cable portion is slidably engaged with the vertical member at the second portion of the vertical member, and a resistance-producing assembly is physically coupled to the first cable portion and the second cable portion. The resistance-producing assembly is operable to apply a resistance to the first cable portion independent of movement of the second cable portion and apply a resistance to the second cable portion independent of movement of the first cable portion;

In accordance with the present invention, the method further includes simultaneously pulling the first cable portion and the second cable portion to cause the resistance-producing assembly to move and generate a resistance in response to both cables being pulled together.

Although the invention is illustrated and described herein as embodied in a ski ergometer, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which.

DETAILED DESCRIPTION OF THE INVENTION

Figure 1:
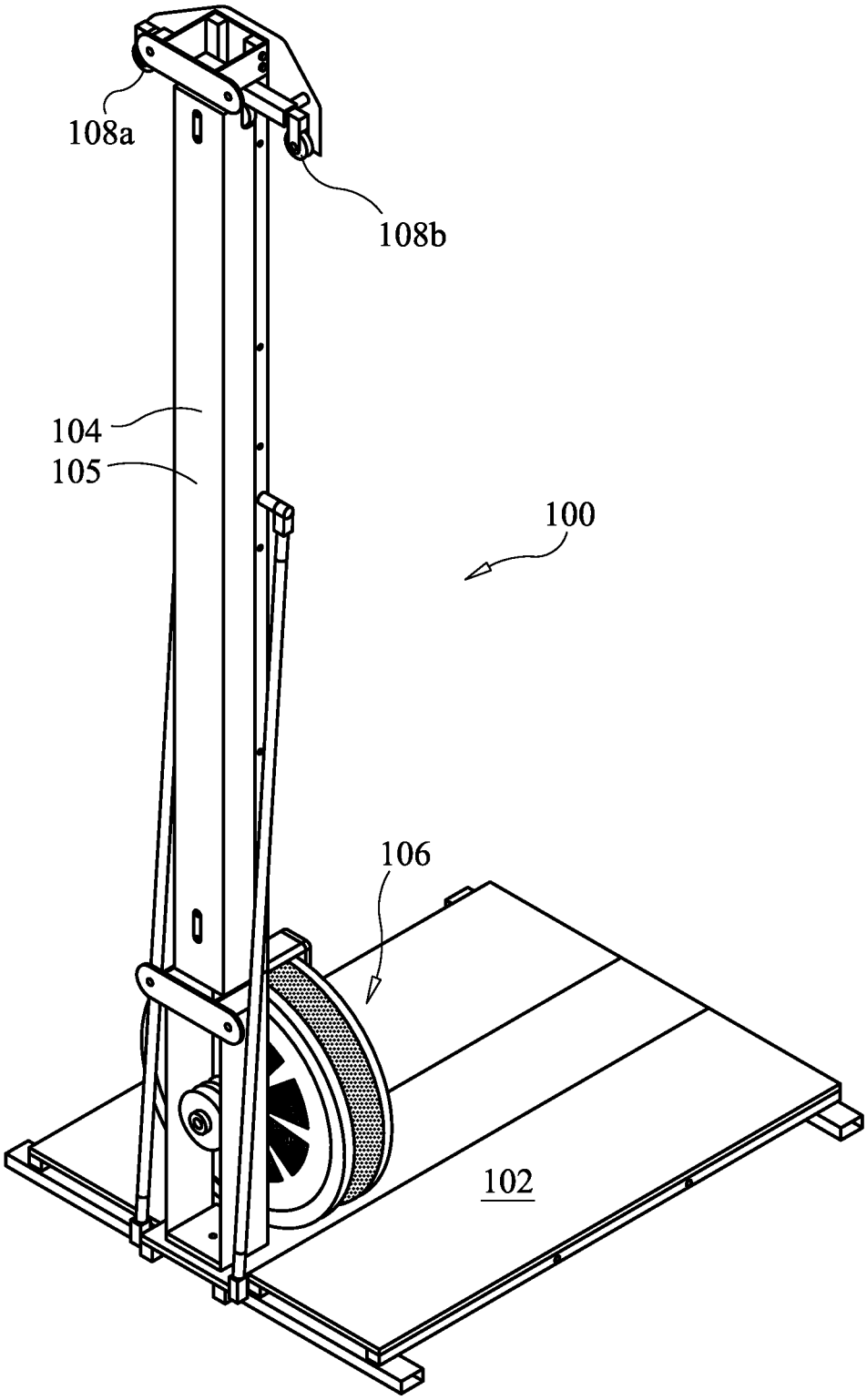
FIG. 1 is a fragmentary, perspective downward looking view of a ski-movement-simulation ergometer assembly in accordance with an embodiment of the present invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein, various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments of the present invention. Referring now to the figures of the drawings in detail and first, particularly to FIG. 1, there is shown a first exemplary embodiment of a ski-movement-simulation ergometer assembly 100. The inventive ski-movement-simulation ergometer assembly 100 includes a platform 102 for supporting a user during use of the assembly 100. The ski-movement-simulation ergometer assembly 100 further includes a vertical member 104, a resistance-producing assembly 106, and a set of pulleys 108*a* and 108*b*. A cover 105 covers and protects further assembly components of the vertical member 104, which are shown in FIG. 2 and described below. As will be apparent from the following description (and FIG. 29), the ski-movement-simulation ergometer assembly 100 can be provided without a platform 102, thereby advantageously conserving floor space in the area where the inventive device is placed.

Referring now to the back-side view FIG. 2, where the cover 105 is removed, first and second cables 110*a* and 110*b*, with a pair of handles 111*a* and 111*b* attached, are shown as passing through and within the vertical member 104. As will be described in detail below, the first and second handles 111*a* and 111*b*, when gripped by a user, can be used in an individual manner to cause movement of the first and second cables 110*a* and 110*b*, which, in turn, causes the resistance-producing assembly 106 to apply resistance to the first and second cables 110*a* and 110*b* individually—a feature not found in the prior-art ski ergometers.

As the partial back view of FIG. 2 shows, the ergometer assembly 100 includes a set of pulleys 108*a*, 108*b*, 202, 204, 206, 208, 210 that secure and guide the first and second cables 110*a* and 110*b* through the vertical member 104. The set of pulleys includes first and second outer pulleys 108*a* and 108*b*, respectively. The set of pulleys further includes first and second inner pulleys 202*a* and 202*b*, respectively, an upper center pulley 206, an anchor pulley 208, and a resistance pulley assembly 210. From this view, it is clear that the cables 110*a* and 110*b* travel through the vertical member 104 and engage the resistance-producing assembly 106 through the resistance pulley assembly 210. The physical relationship between the first and second cables 110*a* and 110*b* and the set of pulleys 108*a*, 108*b*, 202, 204, 206, 208, 210 is shown in further detail in FIGS. 3-12.

Figure 3:
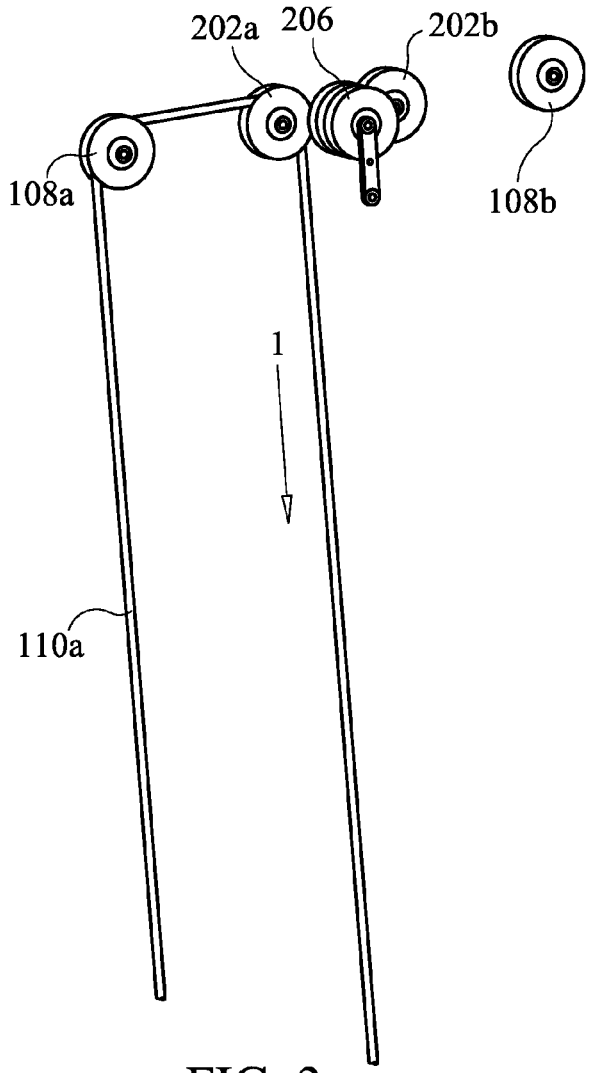
FIGS. 3-10 show various fragmentary partial views of the cable path through pulleys of the ski-movement-simulation ergometer of FIGS. 1 and 2.

Referring first to FIG. 3, the first and second inner pulleys 202*a* and 202*b*, respectively, and the upper center pulley 206 are shown isolated from the ski ergometer assembly 100. In this view, the first cable 110*a* is shown being installed by first being fed over the first outer pulley 108*a* from a side of the device opposite the first inner pulley 202*a*. The first cable 110*a* is then fed over the first inner pulley 202*a* in a direction that places the first cable 110*a* between the first inner pulley 202*a* and second inner pulley 202*b*. The first cable 110*a* then travels in a downward direction indicated in FIG. 3 with arrow 1.

Figure 4:
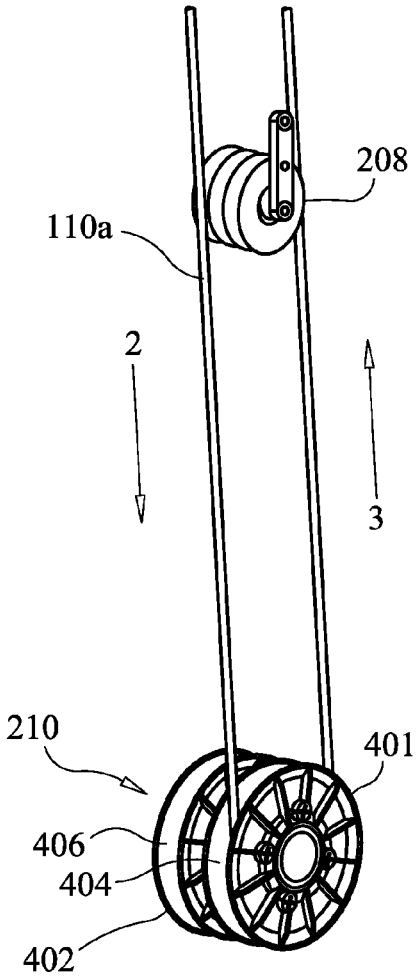

Looking next to FIG. 4, as indicated by arrow 2, it can be seen that the first cable 110*a* extends down to the resistance pulley assembly 210 and engages with a channel 404 of the first pulley 401 of the resistance pulley assembly 210. As will be explained below, the pulley 401 includes a clutch assembly that serves as an engagement member for physically coupling to a shaft upon which it is mounted. As with pulleys 108*a* and 202*a*, which each have a channel for guiding the cable 110*a*, the channel 404 of the resistance pulley assembly 210 ensures that the first cable 110*a* remains physically engaged with the first pulley 401 as the first cable 110*a* moves in a longitudinal direction of the cable. Continuing on, as indicated by arrow 3, the first cable 110*a* extends upwardly to a connection shown in FIG. 5.

Figure 5:
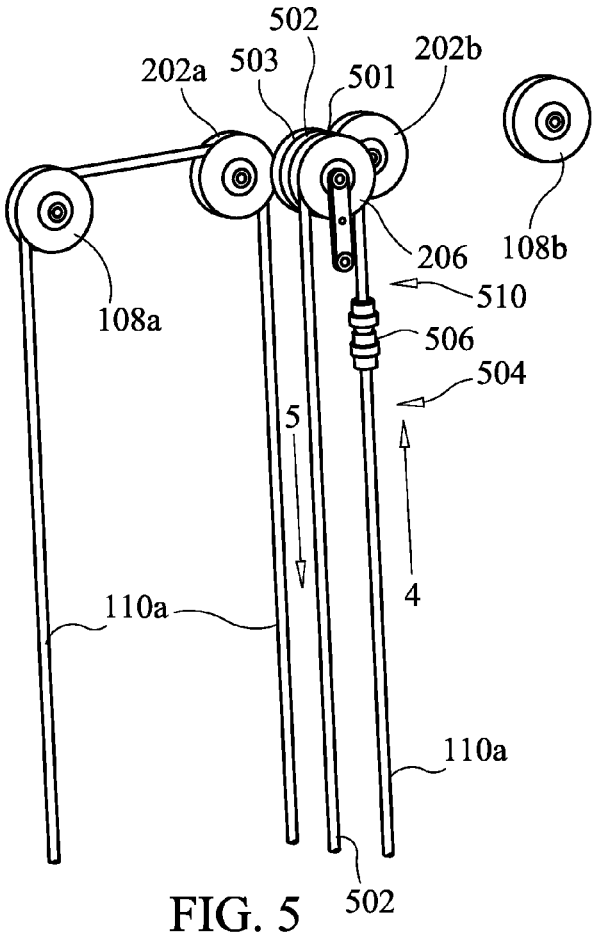

FIG. 5 shows a coupler 506 attached to a distal end 504 of the first cable 110*a*. The coupler 506 can be any mechanism for attaching one cable to another cable and can also include tying the cables together in a knot. In the embodiment shown in FIG. 5, the coupler 506 connects the distal end 504 of the first cable 110*a* to a proximal end 510 of an intermediate cable 508. In accordance with one embodiment of the present invention, the first cable 110*a* and the second cable 110*b* have a minimal amount of elasticity while the intermediate cable 508 expresses elasticity, i.e., stretchable properties. For example, the first cable 110*a* and the second cable 110*b* can be standard rope-type cables used in exercise equipment. The intermediate cable 508 can be made of rope, elastic, rubber, or other similar materials that stretch more than the first and second cables 110*a* and 110*b*.

The intermediate cable 508 engages with the upper center pulley 206. More specifically, the intermediate cable 508 engages with and is received by a first 501 of three channels 501, 502, 503 within the upper center pulley 206. The intermediate cable 508 exits the first channel 501 and continues in a downward direction identified by arrow 5 in FIG. 5.

Figure 6:
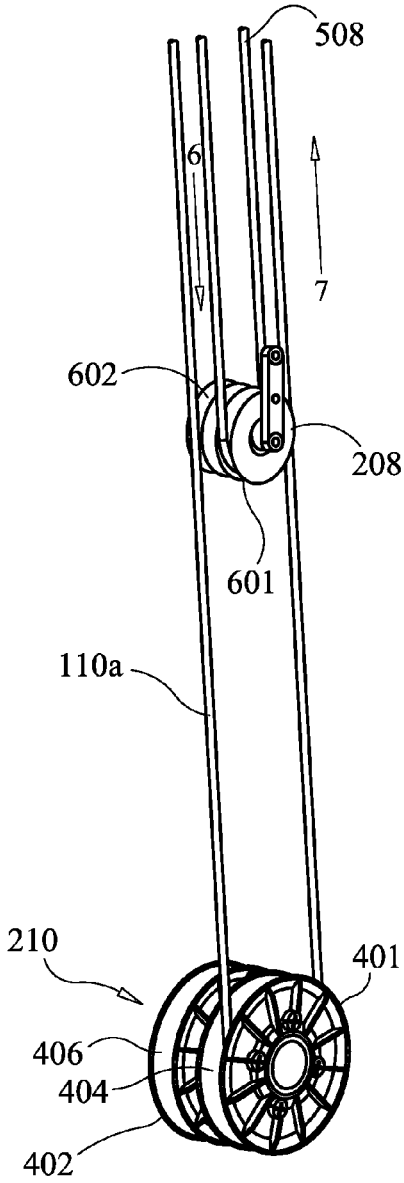

Continuing on to FIG. 6, the intermediate cable 508 is shown as continuing in a downward direction and engaging with a first 601 of two channels 601, 602 within the anchor pulley 208. The intermediate cable 508 makes a U-turn, exits the first channel 601 of the anchor pulley 208, and continues upwards in a direction indicated by arrow 7.

Figure 7:
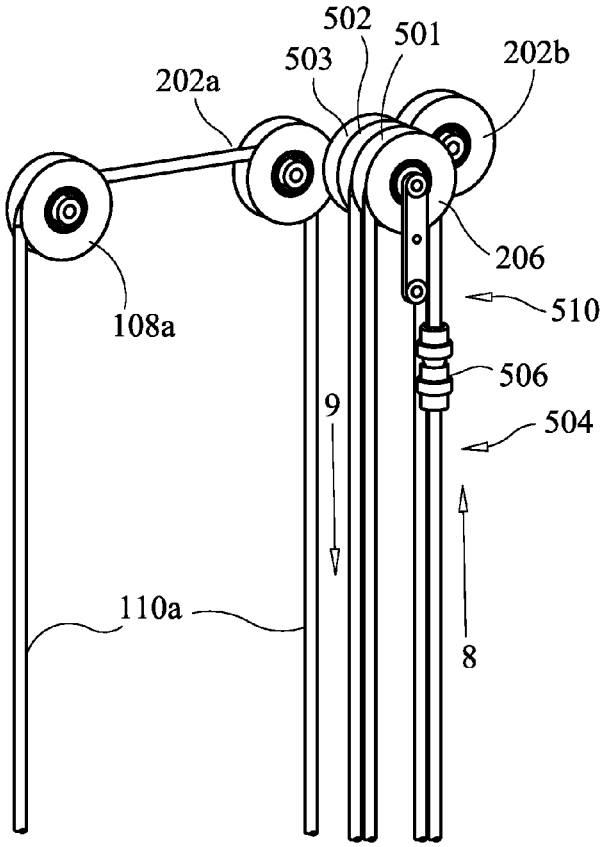

Referring now to FIG. 7, it can be seen that the intermediate cable 508 now engages with a second channel 502 of the upper center pulley 206 and once again continues in a downward direction, indicated by arrow 9. The intermediate cable 508 then engages with a second channel 602 of the anchor pulley 208, as shown in FIG. 8, so that portions of the intermediate cable 508 occupy both the first channel 601 and the second channel 602 of the anchor pulley 208.

Figure 8:
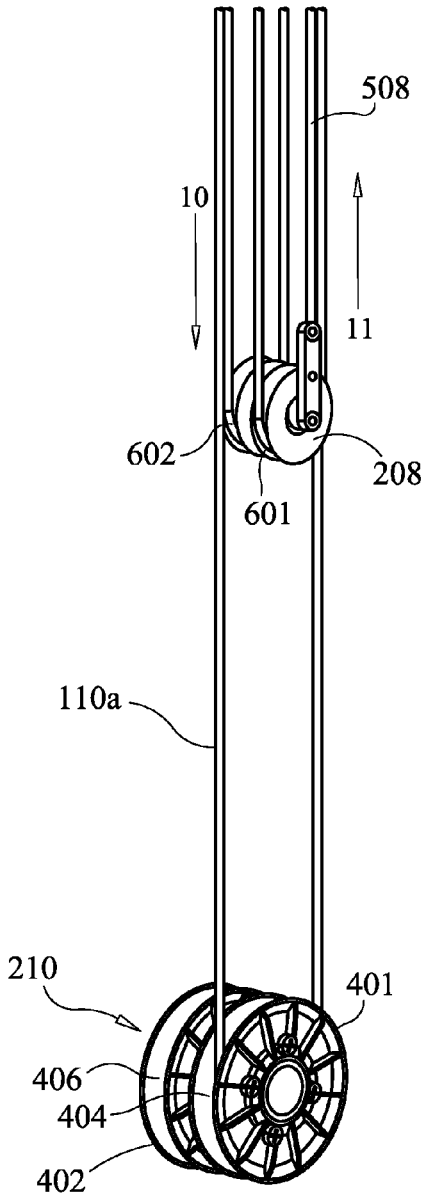
Figure 9:
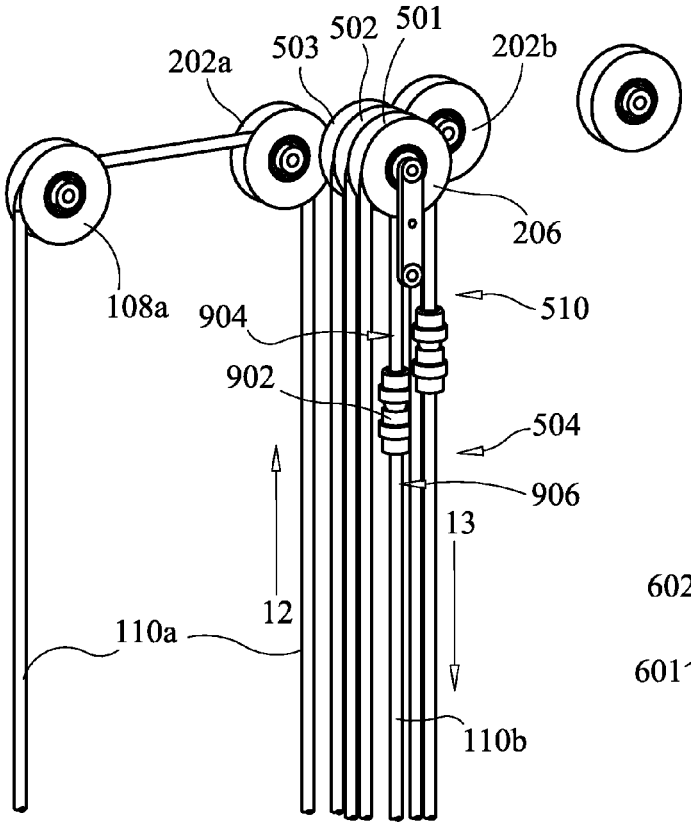

The intermediate cable 508 once again continues in an upward direction, indicated by arrow 11 in FIG. 8. As FIG. 9 shows, the intermediate cable 508 returns upwardly and engages with a third channel 503 of the upper center pulley 206 so that all three channels 501, 502, 503, are occupied by portions of the intermediate cable 508. A short distance after the intermediate cable 508 exits the third channel 503 of the upper center pulley 206, the intermediate cable 508 is attached to a coupler 902. The coupler 902 can be any mechanism for attaching the intermediate cable 508 to another cable. In this case, the coupler 902 couples a distal end 904 of the intermediate cable 508 to a proximal end 906 of the second cable 110*b*.

Figure 10:
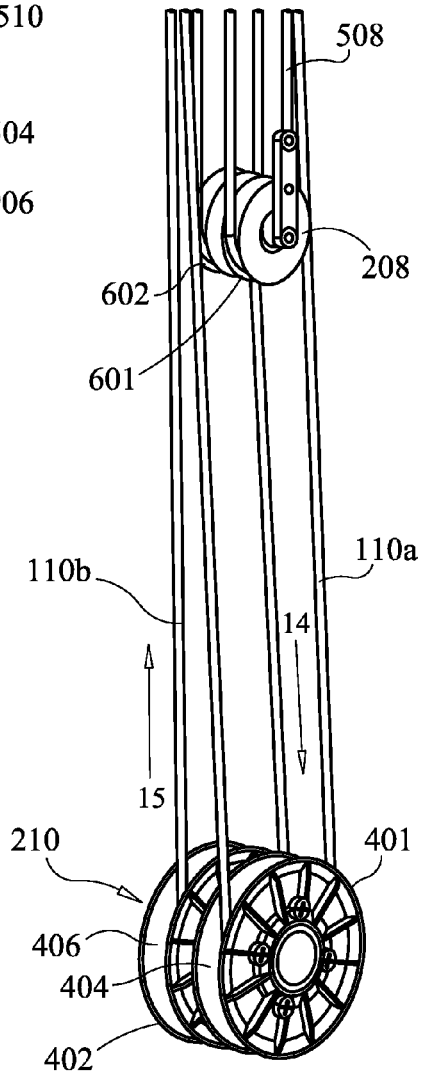

Looking now to FIG. 10, the second cable 110*b* winds around a second pulley 403 of the resistance pulley assembly 210, passing through its channel 406. The side elevational view of FIG. 13 clearly shows this relationship between the first cable 110*a*, the second cable 110*b* and the two channels 401 and 402 of the resistance pulley 210. Referring briefly back to FIG. 2, it can be seen that the second cable 110*b* extends back up and around the second inner pulley 202*b* and over the second outer pulley 108*b*.

Figure 11:
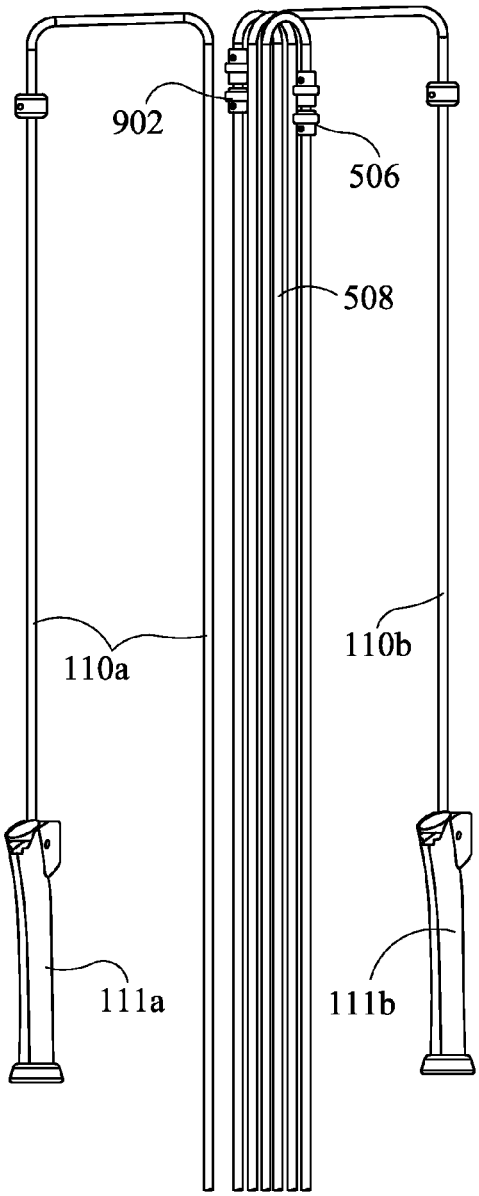
FIGS. 11 and 12 show partial elevational views of the cable winding shape within the ski-movement-simulation ergometer of FIGS. 1 and 2 and through the pulleys of FIGS. 3-10.
Figure 12:
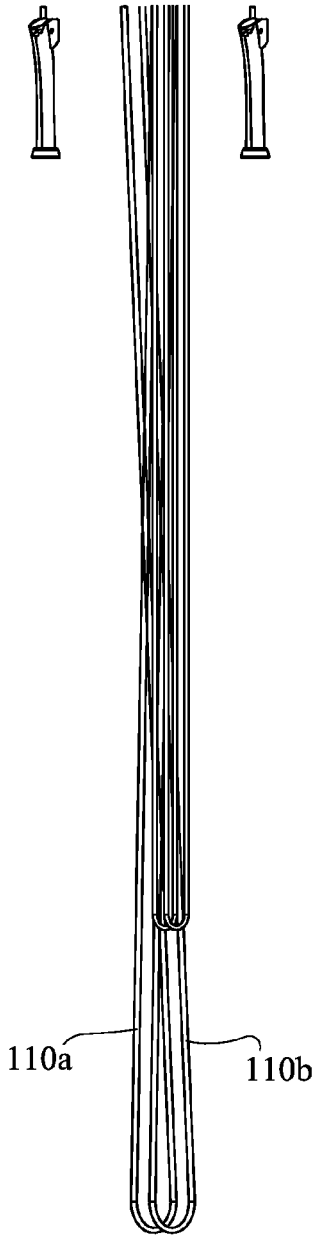

FIGS. 11 and 12 provide an elevational partial view of the first and second cables 110*a*, 110*b* and the intermediate cable 508, without showing the pulleys. These views illustrate the path of the cables 110*a*, 110*b*, and 508 which, because of the couplers 506, 902, are actually a single cable routed through the device in an inventive manner. As will be explained detail below, the cables 110*a*, 110*b*, and 508 cause a flywheel (not shown in FIGS. 11 and 12) to move regardless of which handle 111*a*, 111*b* is pulled. Once again, the first and second cables 110*a*, 110*b*, in accordance with one embodiment, are of a solid, i.e., relatively non-elastic, rope or other cable-type material that is resistant to stretching to any significant degree. The intermediate cable 508 is of a stretchable elastic-type material. The stretchable intermediate cable 508 provides a dramatically improved realistic feel when the user is pulling on the handles 111*a* and 111*b*. Notably, the single cable formed by the three separate cables 110*a*, 110*b*, 508 allows both double and single pole operation with one cable because a stretchable central cable section connects the two solid cable sections to each other. No matter which handle is pulled and without regard to the order in which the handles are pulled, there is always a smooth resistive force applied to the handle. More specifically, FIG. 2 shows that handle 111*a* is coupled to cable 110*a*. FIG. 10 shows that cable 110*a* runs through the first pulley 401 and, when the handle 111*a* is pulled, the first cable 110*a* causes the first pulley 401 to rotate. Because the cable system of the present invention is one continuous cable, the stretchable intermediate cable 508 allows the second handle 111*b* to remain stationary. When the second handle 111*b* is pulled, its cable 111*b* already has tension placed on it by the partially stretched intermediate cable 508. Therefore, when the second handle is pulled, even if the flywheel is already spinning, there is no dead spot and, advantageously, no jerking sensation as is found as is present in the spinning shaft and clutch system of prior art devices, which require the clutch to catch up with the already spinning cable with every pull of the handle.

Figure 13:
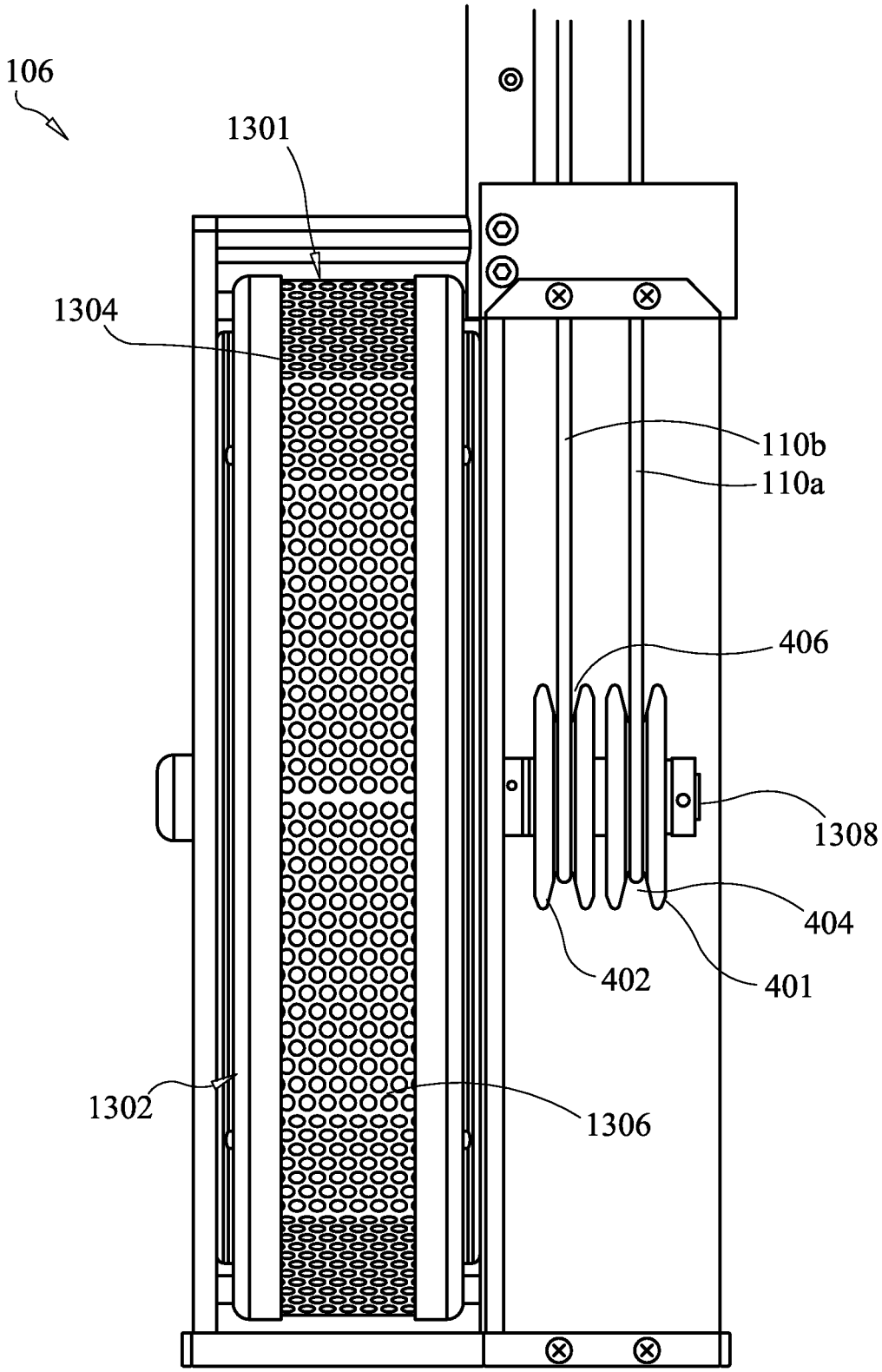
FIG. 13 is an elevational close-up view of the front side of the resistance-producing assembly of the ski-movement-simulation ergometer assembly of FIGS. 1 and 2.

Referring now to FIG. 13, a close-up elevational edge view of the resistance-producing assembly 106 is shown. The resistance-producing assembly 106 includes the first 401 and second 402 pulleys and shows the first 110*a* and second 110*b* cables residing within the channels 404 and 406 of the first 401 and second 402 pulleys, respectively.

Further, the first 401 and second 402 pulleys are coupled to a shaft 1308 of the resistance-producing assembly 106. As will be described in detail below, the first 401 and second 402 pulleys can be rotated independently from each other when the first 110*a* and second 110*b* cables are moved, which causes rotational movement of the shaft 1308.

Figure 14:
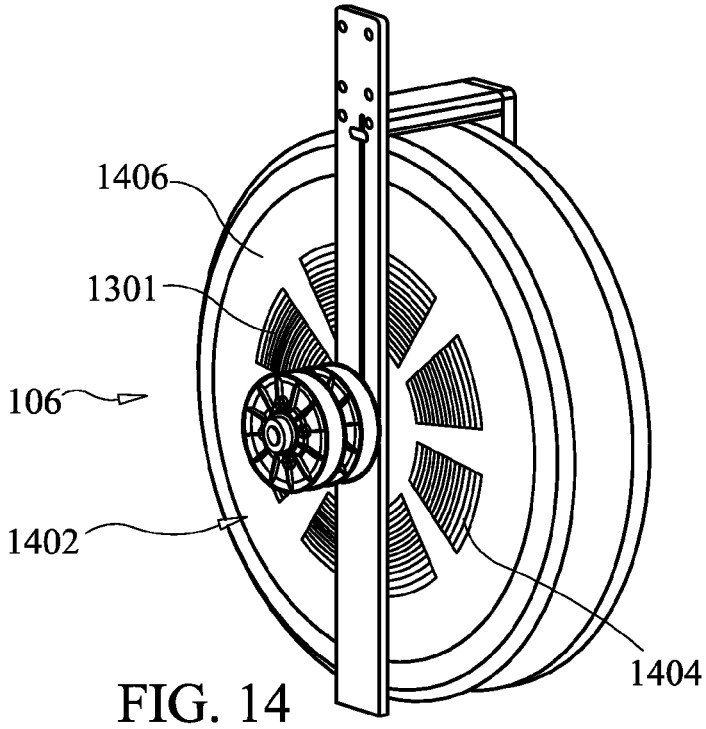
FIG. 14 is perspective view of the rear side of the resistance-producing assembly of FIG. 13.
Figure 15:
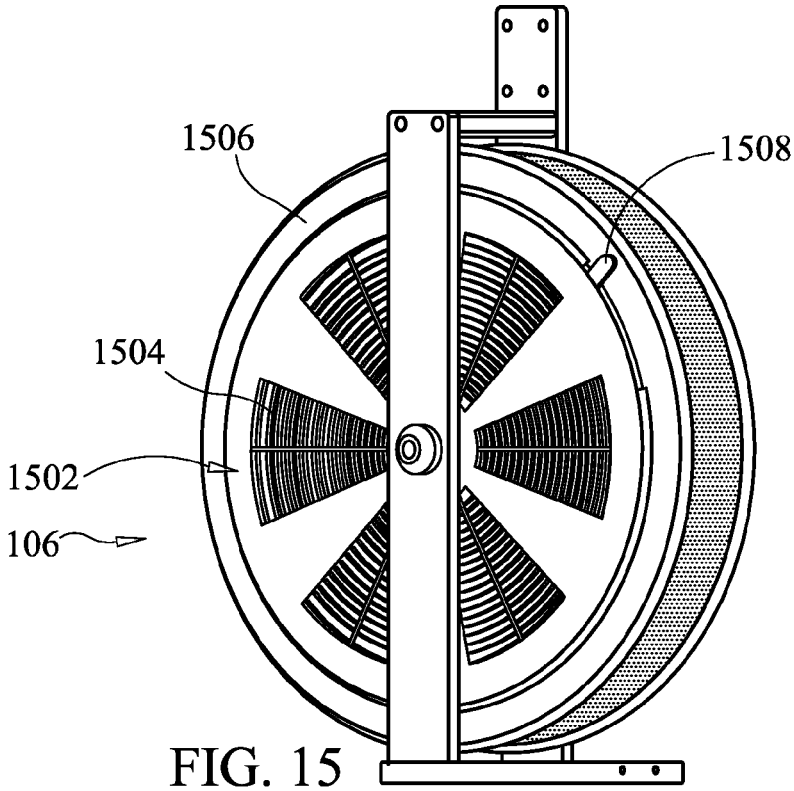
FIG. 15 is a perspective view of the front side of the resistance-producing assembly of FIG. 13.

Each of the close-up views of FIGS. 13-15 shows that the resistance-producing assembly 106 includes a flywheel 1301, which is mechanically coupled to the shaft 1308. The flywheel 1301, in accordance with one embodiment of the present invention, employs air resistance to apply, through the shaft 1308, resistive forces to the cables 110*a* and 110*b*. For air resistance, the resistance-producing assembly 106 uses fanlike air fins on the flywheel 1301, which is housed within a cage 1302. However, other measures for applying resistance can be used within the spirit and scope of the present invention.

In accordance with an embodiment of the present invention, each pulley 401 and 402 is provided with a clutch mechanism that allows it to individually, i.e., without regard to the other pulley, cause the flywheel 1301 to spin. That is, each clutch mechanism engages the shaft 1308 only in only one rotational direction and allows the shaft 1308 to rotate freely in that direction relative to the clutch. In other words, if, for example, pulley 401 was provided with a clockwise clutch, when the pulley 401 was rotated clockwise around the shaft 1308, the clutch would grab the shaft 1308 and cause the shaft to rotate with the pulley 401. However, once the shaft 1308 is spinning, the pulley 401 can remain stationary and the clutch will allow the shaft 1308 to spin freely within the pulley 401. This scenario applies to the second pulley 402 as well.

Clutches and clutch mechanics are well known in the art and, therefore, are not described in great detail herein. Through utilization of the clutch mechanics, movement of the first pulley 401, independent of the position or movement of the second pulley 402, causes the shaft 1308 and flywheel 1301 within the cage 1302 to have a corresponding rotational motion. Similarly, movement of the second pulley 402, independent of the position or movement of the first pulley 401, causes the flywheel 1301 within the cage 1302 to have a corresponding rotational motion without affecting the first pulley 401. Even more specifically, in accordance with an embodiment of the present invention, when activated, both pulleys 401, 402 cause the shaft 1308 to rotate in the same direction, e.g., clockwise. However, when either one of the pulleys 401, 402 is stationary or rotated in a direction opposite the active spinning direction of the shaft 1308, the shaft 1308 is able to substantially frictionlessly rotate independently of the pulleys 401, 402.

As previously described, and as is shown in FIGS. 13-15, coupled to and guided by the first pulley 401 is the first cable 110*a*. Similarly, coupled to and guided by the second pulley 402 is a second cable 110*b*. As either one of the cables 110*a*, 110*b* is pulled by the user, the flywheel 1301 is caused to spin within the cage 1302. In response, the air fins 1306 on the flywheel 1301 push against the air present within the cage 1302 and create a corresponding resistance on the shaft 1308.

Advantageously, the present invention provides control over the amount of air that passes through the air intake apertures 1304 forming a portion of the cage 1302. More specifically, FIG. 14 shows a first side 1402 of the resistance-producing assembly 106, which has a first set of apertures 1404 formed in a circular pattern within its side cover 1406. A circular pattern, however, is not required.

FIG. 15 shows a second side 1502 of the resistance-producing assembly 106, which has a second set of apertures 1504, also formed in a circular pattern, in its side cover 1506. Again, a circular pattern is not required. Both of the sets of apertures 1404, 1504 allow air to pass into and out of the cage 1302. As less air is allowed to pass through the apertures 1404, 1504 of the cage 1302, the flywheel 1301 is able to spin more freely and the resistance of the flywheel 1301 is decreased. Conversely, as more air is able to pass through the apertures 1404, 1504 of the cage 1302 a resistance applied to the cables 110*a*, 110*b* is increased.

Figure 24:
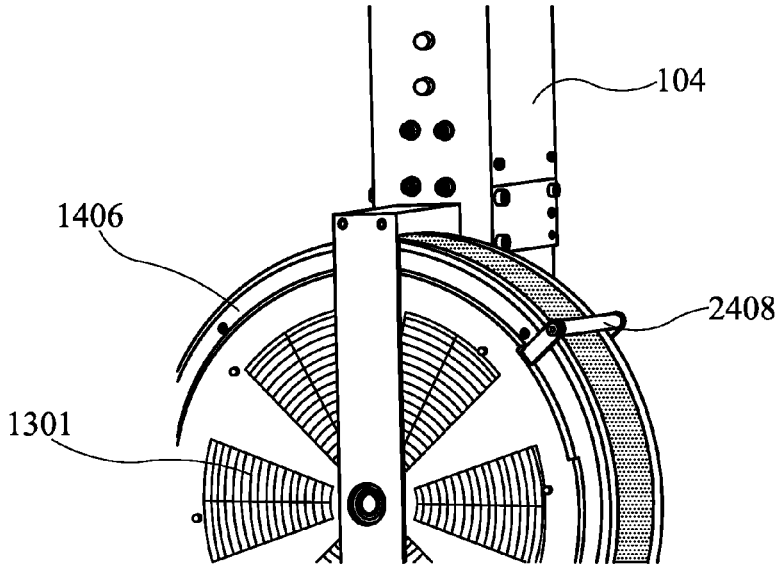
FIG. 24 is a partial close-up view of the front side of the resistance-producing assembly of FIGS. 1 and 2 showing an air aperture closing lever in accordance with the present invention.

In accordance with embodiments of the present invention, portions of the first set of apertures 1404 and/or portions of the second set of apertures 1504 are able to be adjustably blocked to control the amount of air that is able to pass through the apertures 1404, 1504. Specific to the embodiment shown in FIG. 15, a lever 1508 is movable from the fully-open position depicted in FIG. 15 to one of several other positions that block all or a portion of the apertures 1504. FIG. 24 shows an embodiment of a lever 2408 that is coupled to both the first side cover 1406 and the second side cover 1506. When moved, the lever 2408 is able to block all or a portion of the apertures 1404 of the first side cover 1406 and the apertures 1504 of the second side cover 1506 at the same time.

Referring again specifically to FIG. 13, where the resistance-producing assembly 106 is shown in an elevational side view, it can be seen that a circumferential portion of the cage 1302 is formed from a screen forming apertures 1304. The apertures 1304 allow air to pass into or out of an interior of the cage 1302, thereby affecting the resistance of the spinning flywheel 1301. In accordance with embodiments of the present invention, portions of the apertures 1304 can be adjustably blocked to control the amount of air that is able to pass into/through the cage 1302. The lever 1508 or 2408 can, in accordance with one embodiment, be used to block all or a portion of the apertures in the screen 1304.

The amount of or number of the apertures 1304, 1404, 1504 that are blocked directly affects the amount of resistance that the flywheel 1301 applies to the cables 110*a* and 110*b*. Therefore, advantageously, the present invention can be specifically set to accommodate users of varying strength, fitness, and training goals and to mimic varying skiing conditions.

Advantageously, and unlike any ski-training device in the prior art, movement of the first cable 110*a*, by itself, will move only pulley 401 and cause the flywheel 1301 within the cage 1302 to spin. The flywheel, which, of course, has weight and inertia to overcome before and while spinning, provides a variable resistance that is applied to the first cable 110*a*. Independently, movement of the second cable 110*b*, by itself, will cause only pulley 402 to rotate on the shaft and cause the flywheel 1301 within the cage 1302 to spin. Again, the flywheel applies a resistance to the second cable 110*b*. It is only through the present invention that a user is able to affect the flywheel independent of the other hand and experience ski-type movement and resistive pressure on only a single arm at any given time, thereby creating a realistic full range of motion that simulates actual skiing.

As a more specific example, in real snow conditions, if a skier were to go from a stationary position to a moving position on skis, a certain amount of force is necessary in order to propel the skier's body forward. Once the skis are gliding across the snow, the force required to keep the skis gliding would be less than the force required to move the skier from stationary to moving. Therefore, the skier generally uses both arms to move from a stationary position to a moving trajectory. However, once the skier is in motion, a push by each individual arm requires less force than the force required to initially propel him forward. With the present invention, as an initial movement, if the user so chooses, he can pull both cables 110*a*, 110*b* down to cause the flywheel 1301 to begin spinning. Of course this also causes the shaft 1308 to have a corresponding rotation. At this point, either one of the cables 110*a*, 110*b* can be used in an alternating fashion to cause their corresponding pulleys 401, 402 to selectively engage with the shaft 1308 and cause it to continue its rotation. In other words, either one of the cables 110*a*, 110*b* places a resistive force on the user's arms, regardless of the position or use of the other cable. However, if both of the cables 110*a*, 110*b* are pulled in unison, they work together to cause the flywheel 1301 to spin, which places a varying resistance on each of the cables 110*a*, 11*b*. In summary, the present invention provides an extremely realistic skiing experience.

As with actual skiing, when only one arm is under pressure, muscles throughout the entire torso are used to prevent the skier from twisting or falling. Therefore, the present invention, unlike other ski devices that target only a certain minor set of muscles, provides an all-body workout.

It should be noted that the present invention is not limited to only air-resistance flywheels for forming the resistance-producing assembly 106. In other embodiments, the resistance-producing assembly 106 can utilize magnets, friction, water, oil, pistons, hydraulics, or others.

Figure 16:
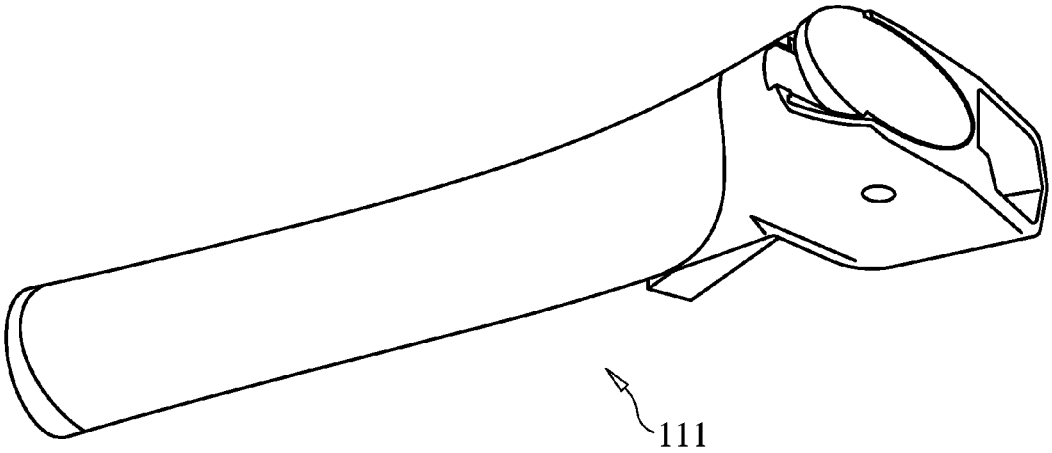
FIG. 16 is a perspective view of a ski handle for use on the ski-movement-simulation ergometer assembly of FIG. 2 in accordance with an embodiment of the present invention.
Figure 17:
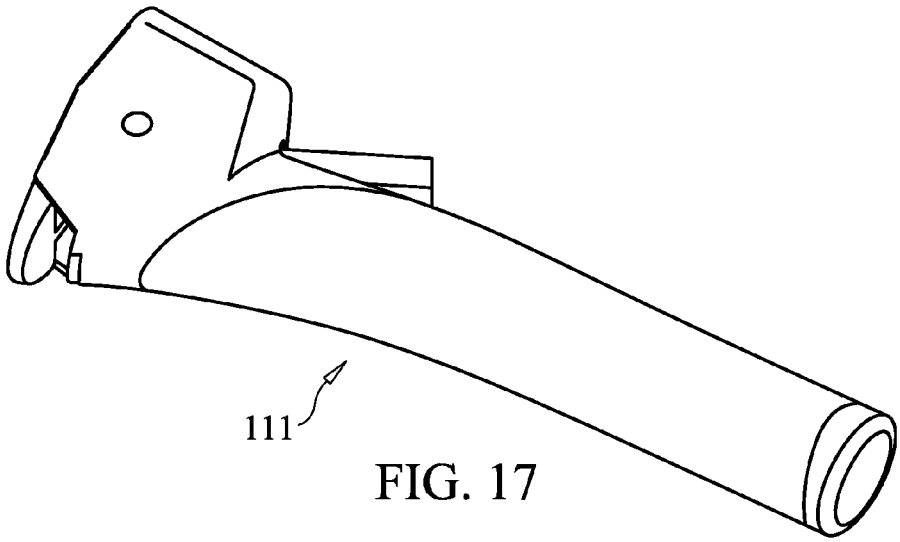
FIG. 17 is a perspective view of the ski handle of FIG. 16.

Referring now to FIGS. 16 and 17, two perspective views of an inventive ski ergometer handle 111 are shown. Advantageously, the ski ergometer handle 111, unlike prior art devices that only provide generic shapeless handles, are formed to simulate the shape and function of actual ski-pole handles. By providing authentic ski-pole-type handle ergonomics, the user's experience on the inventive ski ergometer 100 is dramatically enhanced. The ski handles 111 used with embodiments of the present invention are, however, in no way limited to the shape or proportions shown in the figures.

Figure 18:
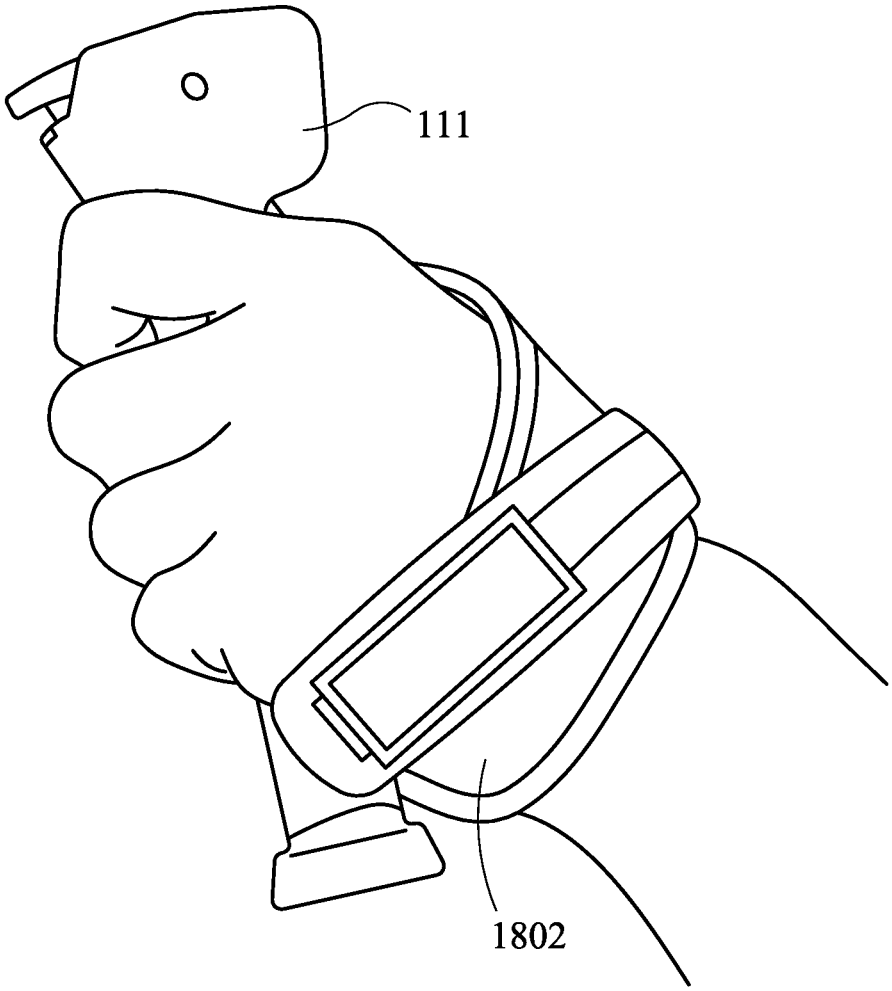
FIG. 18 is an elevational view of a glove coupling a user's hand to the ski handle of FIG. 17.

A relatively new innovation in the ski industry is the ability for a skier to attach their ski gloves to their ski-pole handle. FIG. 18 illustrates this relationship. Through the increased coupling between the skier's glove and/or ski strap 1802 and their ski pole handle 111, a skier is able to apply a much greater amount of force to the pole handle 111 than they can without the coupling. This glove/ski pole coupling is accomplished by securely attaching a clip to the glove and/or ski strap 1802. The clip is then removably attached to a receiver channel formed within a ski-pole handle 111 to form a mechanical coupling between the ski pole handle 111, the glove and/or ski strap 1802, and the user's hand.

Figure 19:
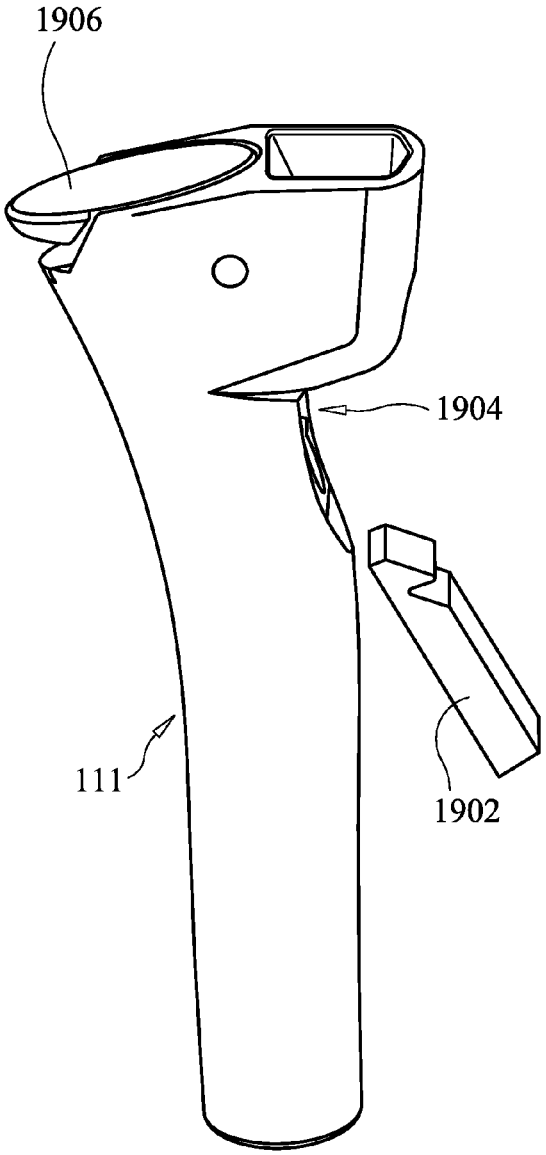
FIG. 19 is a perspective view of the ski handle of FIG. 17 with a glove-attachment clip disengaged from the handle.

One embodiment of the present invention that advantageously implements this feature is shown in FIG. 19. In FIG. 19, the ski-pole handle 111 is shown adjacent a ski-glove and/or ski strap attachment clip 1902. Although the glove 1802 is not shown in this figure, in practice, the exemplary attachment clip 1902 would typically be coupled to the glove 1802.

Figure 20:
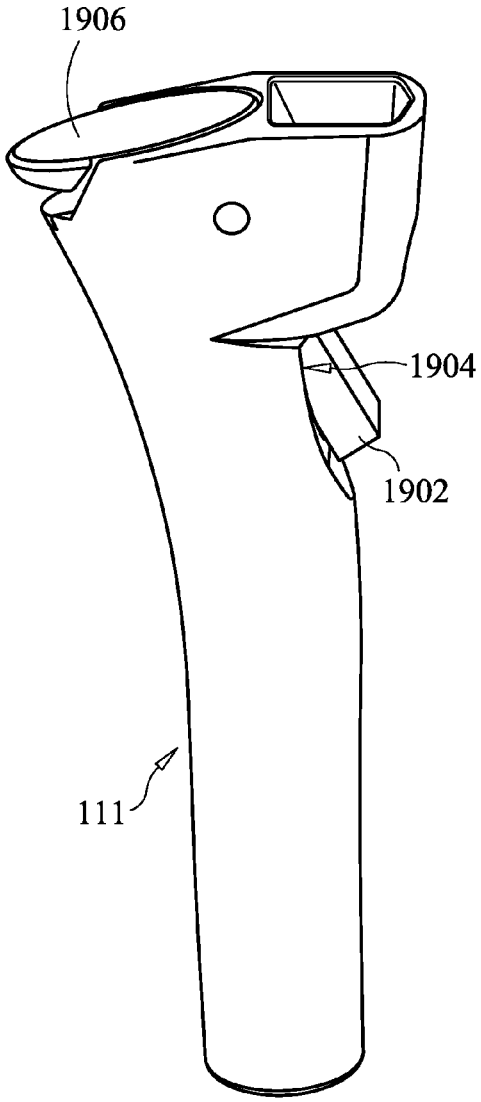
FIG. 20 is a perspective view of the ski handle of FIG. 17 with the glove-attachment clip engaged with the handle.

Referring now to FIG. 20, it can be seen that the attachment clip 1902 is received within a channel 1904 and, once within the channel 1904, is securely coupled to the ski-pole handle 111. The provision of realistic ski-type handles provides a truly realistic experience for the user of the inventive device 100. In addition, a user using the inventive ski ergometer assembly 100 and wearing gloves and/or ski straps 1802 that are clipped into the ski-pole handle 111 can vigorously use the device without fear of the handles 111 slipping from his or her grip.

Referring still to FIG. 19, it can be seen that the inventive handle 111 also features a release button 1906. Once pressed, the release button 1906 releases the attachment clip 1902 and allows it to be easily removed from within the channel 1904 of the handle 111.

Figure 21:
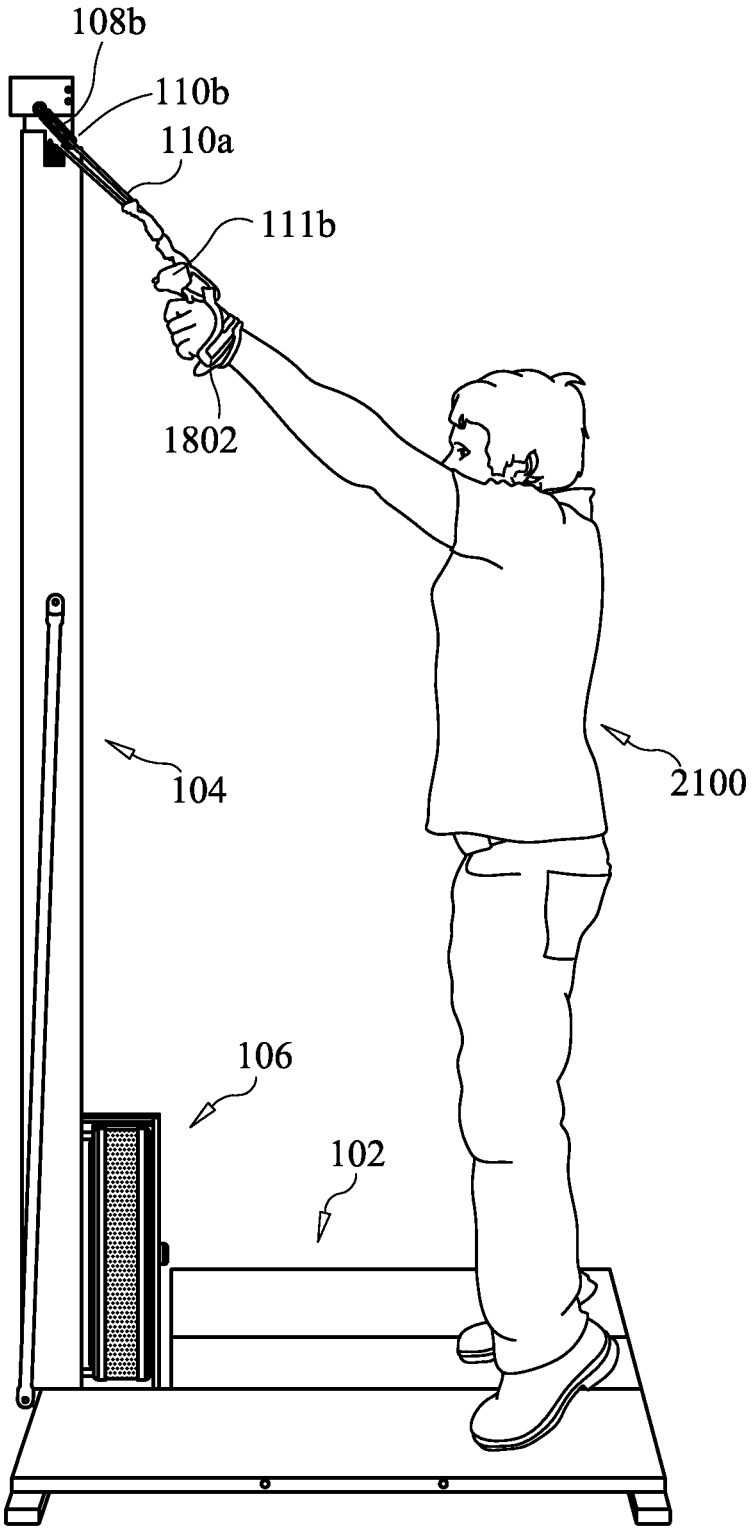
FIG. 21 is a perspective view of the inventive ski-movement-simulation ergometer assembly of FIG. 2 with a user wearing the glove of FIG. 18, holding the handle of FIGS. 17-20, and in a starting position.
Figure 22:
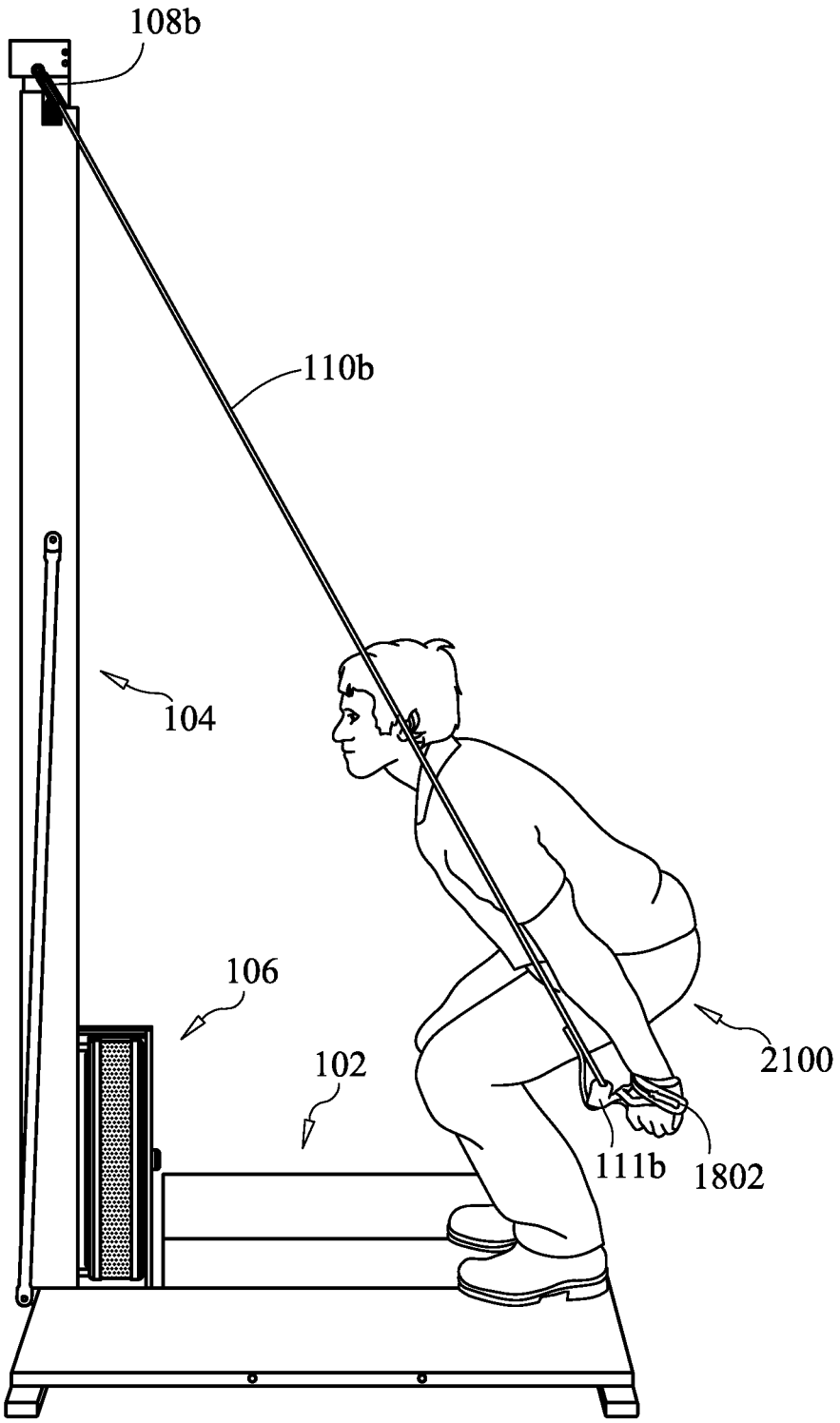
FIG. 22 is a perspective view of the inventive ski-movement-simulation ergometer assembly of FIG. 21 with the user in a double-pole finishing position.
Figure 23:
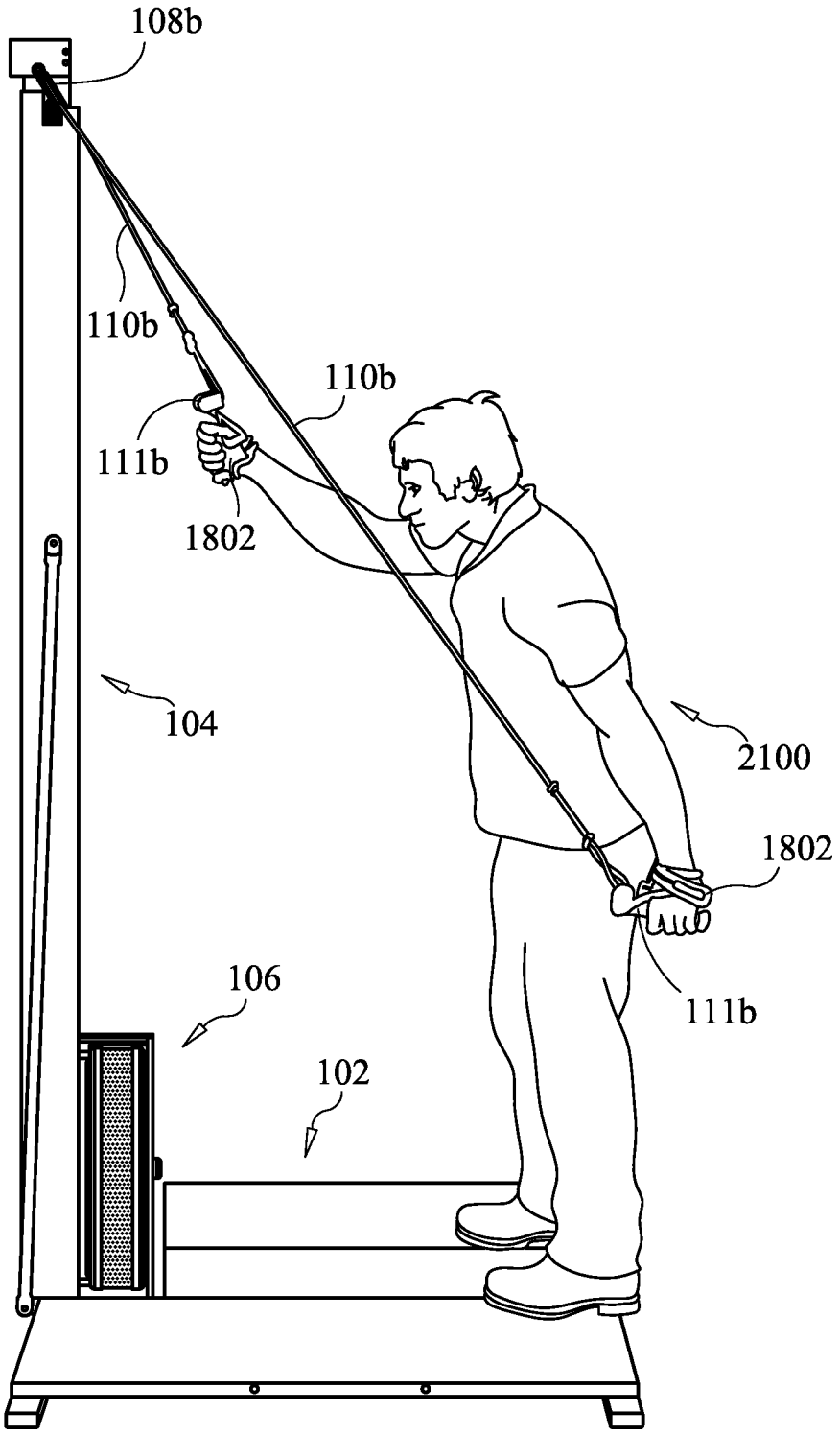
FIG. 23 is a perspective view of the inventive ski-movement-simulation ergometer assembly of FIG. 21 with the user in a single-pole finishing position, where substantially the same resistance is applied to the single down arm as was applied to both arms in the finishing position of FIG. 22 in accordance with the present invention.

FIGS. 21-23 show the ski ergometer assembly 100 in use and illustrate many of the advantageous and novel features provided by the inventive assembly 100. Referring first to FIG. 21, a user 2100 is standing in a starting position. That is, the user 2100 is standing on the platform 102 and is wearing a pair of gloves and/or ski straps 1802 with each glove 1802 attached to one of the two ski handles 111*a* and 111*b* through use of a non-illustrated clip 1902. The first ski handle 111*a* is coupled to the first cable 110*a* and, although difficult to see in the side elevational view of FIG. 21, the second ski handle 111*b* is coupled to the second cable 110*b*. As described above, each of the cables 110*a*, 110*b* travel downward through the vertical member 104 and engage with the resistance-producing assembly 106. The starting position of FIG. 21 further includes the user's hands being near the upper portion of the vertical member 104, i.e., above the user's chest.

Referring now to FIG. 22, the user 2100 has moved completely through a "double pole" exercise move. In this particular move, the user has pulled both of his hands simultaneously toward the platform 102 and in a direction slightly away from the vertical member 104. By pulling both of his hands in a downward direction, both of the cables 110*a* and 110*b* were pulled through the pulley system that includes pulleys 108, 202, 206, 208, and 401 shown and described above. Because both cables 110*a* and 110*b* were pulled simultaneously, both pulleys 401 and 402 of the resistance-producing assembly 106 were caused to spin simultaneously and both received a resistive force provided by the flywheel 1301 of the resistance-producing assembly 106. Therefore, a resistive force was applied to both of the user's arms as he performed the double pole move.

Looking now to FIG. 23, the user 2100 is performing a novel "single pole" move, which is only possible through the inventive mechanics of the present invention. In this move, the user 2100 moved only his left hand a substantial direction from the starting position shown in FIG. 21. This movement of his left hand resulted in the first cable 110*a* being pulled through the inventive pulley system and caused only the first pulley 401 (not illustrated in this view) of the resistance-producing assembly 106 to apply a force to the shaft 1308 (not illustrated in this view). Because the present invention provides a clutch assembly on the second pulley 402 (not illustrated in this view), the second cable 110*b* remains stationary while the first cable 110*a* causes the shaft 1308 (not illustrated in this view) to rotate within the center of the second pulley 402 (not illustrated in this view). Due to the flywheel 1301 (not illustrated in this view) within the resistance-producing assembly 106, a resistive force is applied to the first cable 110*a*. This move shown in FIG. 23, and the resulting resistance felt by the user 2100, closely mimics an actual ski move performed by a skier in real snow conditions.

Figure 25:
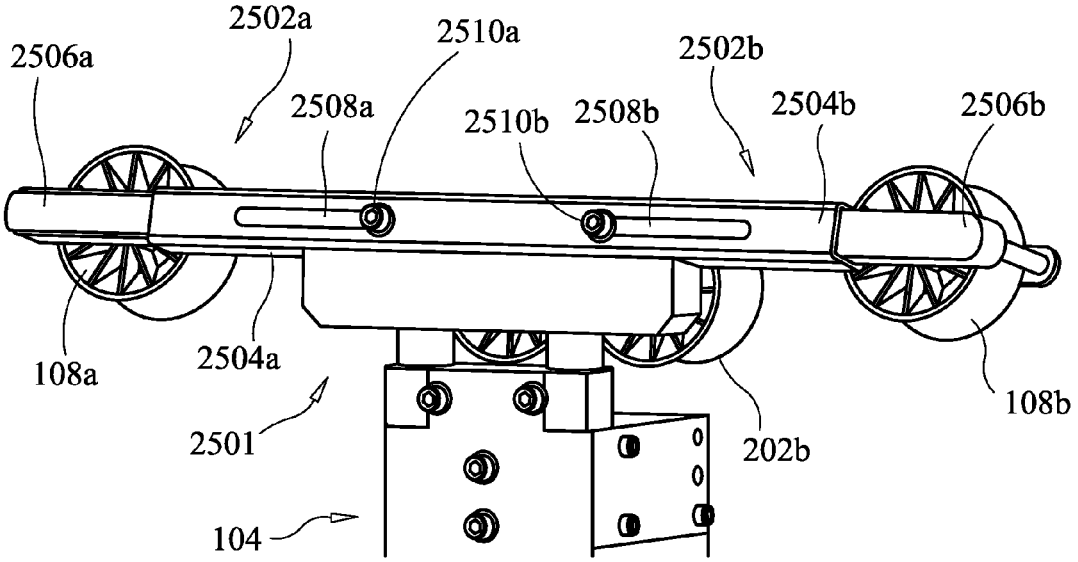
FIG. 25 is a partial perspective close-up view of an upper portion of a ski-movement-simulation ergometer assembly having a head portion with extendable arms in accordance with the present invention.

In addition, the presently inventive ski ergometer assembly 100, in accordance with embodiments of the present invention, provides user customization by allowing adjustment of member dimensions to suit the particular physical dimensions of each user. With reference to FIG. 25, adjustment capabilities of the upper portion of the ski ergometer assembly 100 is shown. Here, a pair of upper arms 2502*a* and 2502*b* include outer sleeves 2504*a* and 2504*b*, respectively, which receive and slidably engage with inner sleeve members 2506*a* and 2506*b*. In this embodiment, each of the outer sleeves 2504*a* and 2504*b* include a slot 2508*a* and 2508*b*. Securing members 2510*a* and 2510*b* pass through the slots 2508*a* and 2508*b* and securely engage with the inner sleeve members 2506*a* and 2506*b*, respectively.

By loosening the securing members 2510, the inner sleeve members 2506 are able to slide relative to the outer sleeves

2504. Once they are in the desired position, the securing members 2510 lock into place, thereby preventing further movements of the inner sleeve members 2506 relative to the outer sleeves 2504. In the embodiment shown in FIG. 25, each of the inner sleeve members 2506 is fully received by the outer sleeves 2504. That is, the securing members 2510 are at a maximum extent of their respective slots 2508 so that the inner sleeve members 2506 cannot move any further into the outer sleeves 2504. In this position, the outer pulleys 108 are at their closest distance from the inner pulleys 202.

Figure 26:
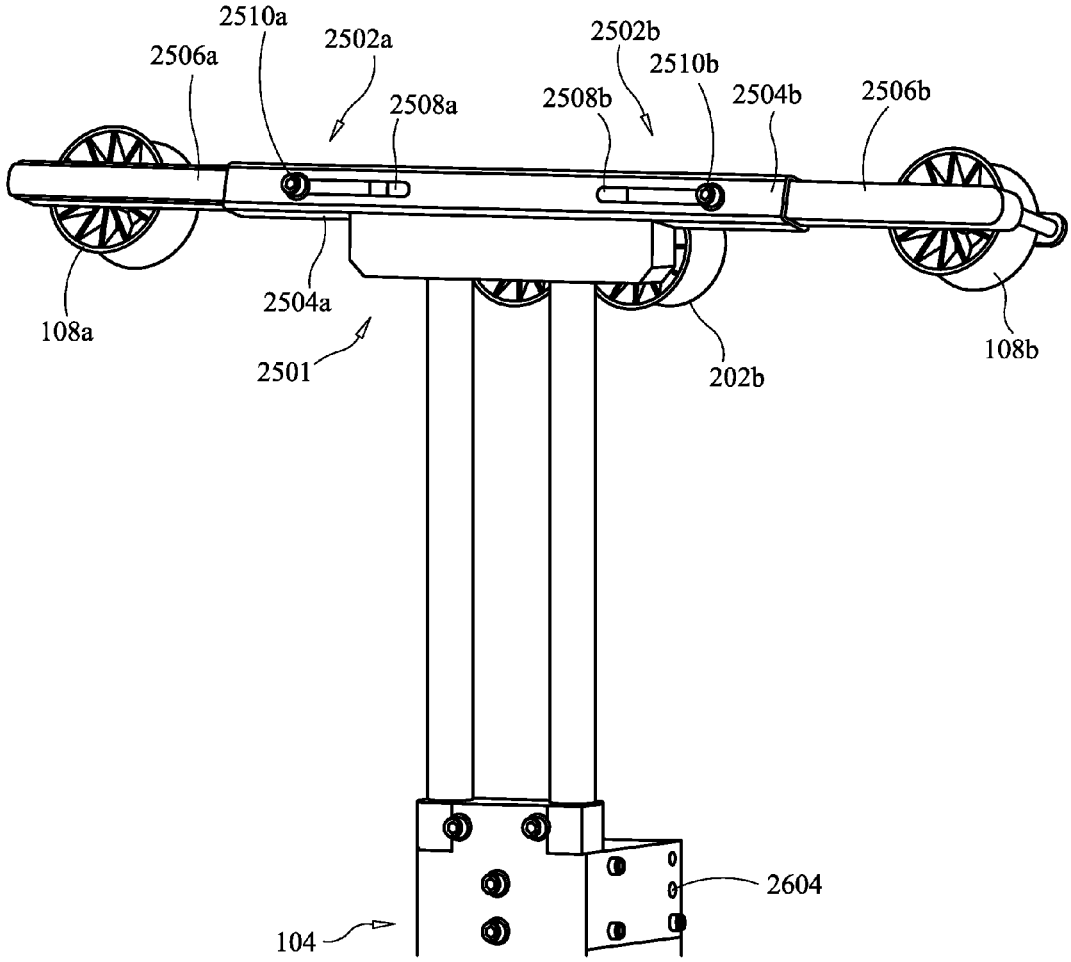
FIG. 26 is a partial perspective view of the upper portion of the ski-movement-simulation ergometer of FIG. 25 showing that the head portion is extendable from the main body portion of the vertical member in accordance with the present invention.

In contrast, FIG. 26 shows the inner sleeve members 2506 extended from the outer sleeves 2504. Here, the securing members 2510 are at their opposite furthest extent of the slots 2508 so that the outer pulleys 108 are at their furthest distance from the inner pulleys 202. By adjusting the inner sleeve members 2506 relative to the outer sleeves 2504, the user 2100 can specifically set the pivot point, i.e., the point where the cables 110 exit the outer pulleys 108, of the cables 110 of the ski ergometer assembly 100. Slight adjustments of the spacing of the inner sleeve members 2506 relative to the outer sleeves 2504 can lead to a large impact in the muscle group that the exercise affects. In addition, this adjustment ability allows the device to be used equally well by small-framed individuals as well as larger-framed individuals.

Figure 27:
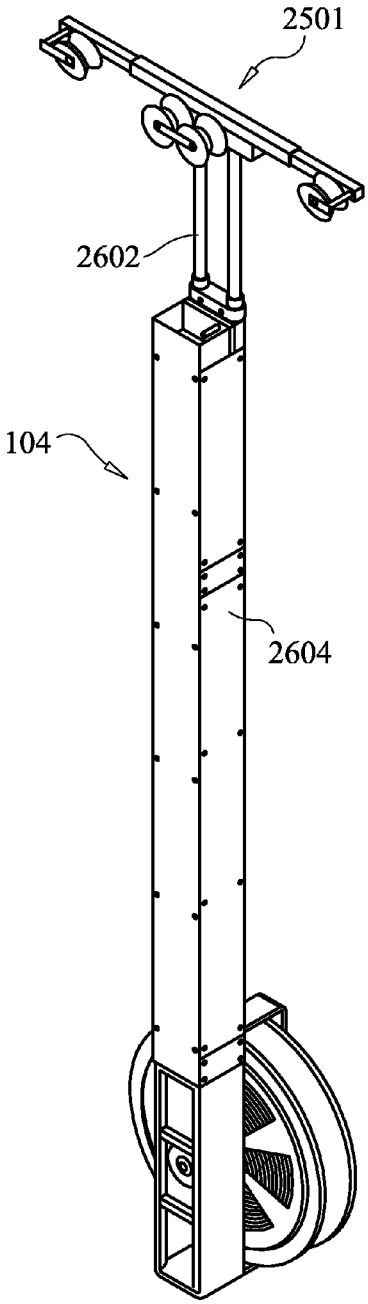
FIG. 27 is a partial perspective view of the head portion extended away from the vertical member of FIG. 25 and a resistance-producing assembly coupled to the vertical member in accordance with the present invention.

In addition, the length of the vertical member 104 can be adjusted so that the inventive device accommodates users of various heights or that prefer various stroke lengths or starting positions. Referring back to FIG. 25, it can be seen that the head portion 2501 of the device is in close proximity to the vertical member 104. Looking now to FIG. 26, it can be seen that the vertical member 104, in at least one embodiment, includes a pair of extendable members 2602 that extend from the main body portion 2604 and move the head portion 2501 upwards and away from the main body portion 2604. This separation of the head portion 2501 from the main body portion 2604 is also illustrated in the perspective downward looking view of FIG. 27. This adjustment advantageously accommodates users of varying heights.

Figure 28:
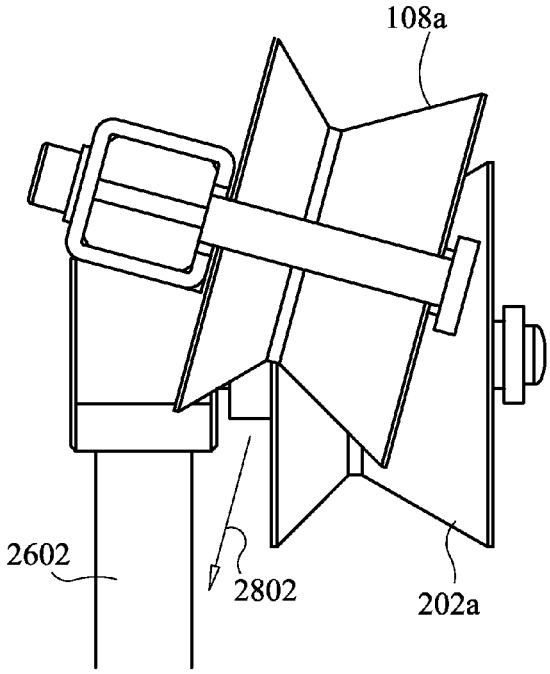
FIG. 28 is an elevational close-up-up side view of the head portion of FIG. 25 showing a difference an alignment between the outer pulley and the inner pulley in accordance with the present invention.

FIG. 28 provides an elevational partial side view of the inventive ski ergometer assembly 100 that shows an alignment of the outer pulley 108*a* relative to an alignment of the inner pulley 202*a*. The outer pulley 108*a*, in accordance with an embodiment of the present invention, is secured at a slight angle that directs a non-illustrated cable in a downward direction and towards the user who will be standing on the front side of the overall assembly 100. Arrow 2802 illustrates this direction. The slight angle of the outer pulley 108*a* provides for a smoother pathway for the non-illustrated cable that, as described above and, in particular, shown in FIGS. 2-13, repeatedly slides in both directions through the pulley system, including the outer pulley 108*a*. Although not illustrated, the opposite outer pulley 108*b* is also tilted at a similar angle.

Figure 29:
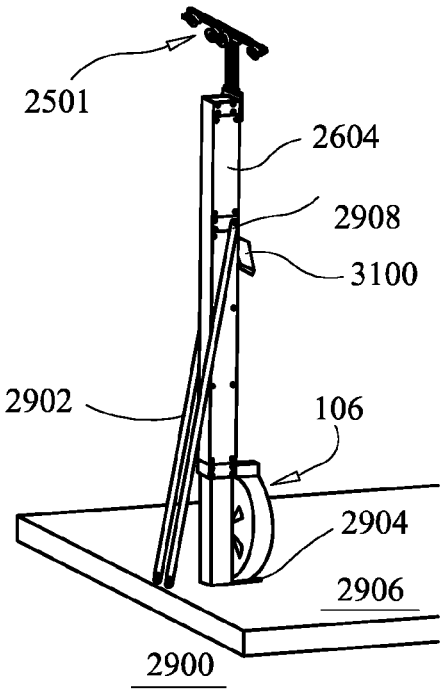
FIG. 29 is an elevational view of a ski-movement-simulation ergometer assembly without a platform and coupled directly to a floor in accordance with the present invention.

Referring now to FIG. 29, a further embodiment of a ski ergometer assembly 2900 is illustrated. This embodiment, similar to the embodiments previously shown and described, includes a resistance-producing assembly 106 coupled to a vertical member 2604, which is itself coupled to a head portion 2501. In this embodiment, there is no platform similar to element 102 shown in FIG. 1. Instead, the vertical member 2604 is attached to the floor 2906 at an attachment point 2904. This can include bolting the lower portion of the vertical member 2604 to the floor 2906. This attachment can also include providing a recessed area within the floor 2906 that will accept a lower portion of the vertical member 2604. Other coupling schemes are also possible. For example, particular embodiments of the present invention allow the assembly to be attached to a wall, which provides structural support and saves space.

The embodiment shown in FIG. 29 also includes a pair of support members 2902. The support members 2902 are coupled, at a first end thereof, to the floor 2906 and, at and opposite end 2908, to the vertical member 2604. Because this embodiment does not include the platform 102, the novel ski ergometer assembly 2900 advantageously takes up very little floor space within the workout area, which is a valuable commodity at many gyms and homes.

Figure 30:
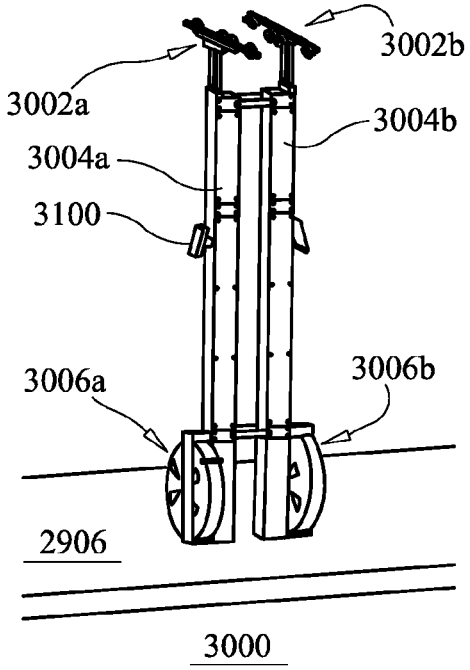
FIG. 30 is an elevational view of a ski-movement-simulation ergometer assembly that includes two resistance-producing assemblies, each without a platform, and each coupled directly to a floor in accordance with the present invention.

A further embodiment of the presently inventive ski ergometer assembly is shown in FIG. 30. FIG. 30 shows a ski ergometer assembly 3000 that includes a pair of vertical members 3004*a* and 3004*b* that are coupled to each other in a parallel adjacent configuration. Each of the vertical members 3004*a* and 3004*b* include, at their base, a resistance-producing assembly 3006*a* and 3006*b*, respectively. At their upper portions, each of the vertical members 3004*a* and 3004*b* include head portions 3002*a* and 3002*b*, respectively. As with the embodiment shown in FIG. 29, the ski ergometer assembly 3000 does not require platforms such as that shown in FIG. 1 labeled as element 102. The inventive ski ergometer assembly 3000 advantageously allows two users to utilize the assembly at any given time, with each vertical member 3004*a* and 3004*b* assisting with stabilization of the other. With this assembly 3000, two skiers can engage in virtual races with one another.

Figure 31:
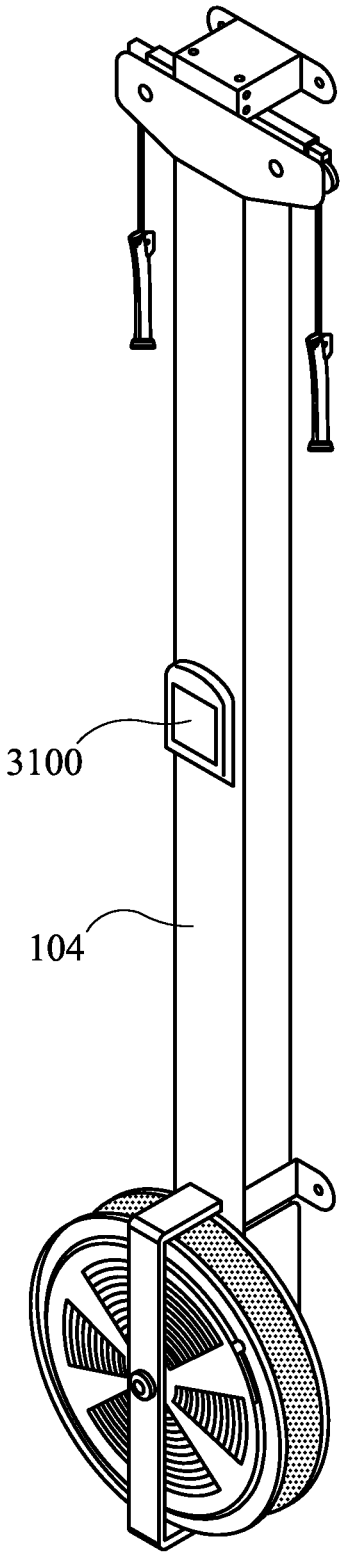
FIG. 31 is a fragmentary, perspective view of the ski-movement-simulation ergometer assembly of FIG. 2 with the platform and cables removed.

Furthermore, the present invention also features a device for measuring and displaying the work performed on the inventive assembly 100. This work-measurement device 3100 is shown in FIG. 31 as being attached to the vertical member 104. In accordance with embodiments of the present invention, the work-measurement device 3100 receives feedback from the resistance-producing assembly 106 and converts that feedback to a measurement of work performed. In further embodiments, the inventive assembly 100 is communicatively connectable to other devices, such as, for example, over the Internet, other networks, direct cable connections, wirelessly, and more, and the users of the devices are able to compete against each other by comparing the measurements of the work-measurement devices 3100 against each other.

Furthermore, the resistance-producing assembly 106 can be provided with a magneto or other electrical-charge-generating device that creates electrical energy as the exercises are performed on the inventive device 100. Configurations that create energy from, for instance, a rotating flywheel, are well known in the art and the details of which are not recited here. However, the present invention can utilize energy produced by the resistance-producing assembly 106 in novel ways. One such use of said energy is to power a video monitor attached, for instance, to the vertical member 104. The monitor could be used to show, for instance, a video of actual skiing, but the invention is, of course, not limited to any specific content displayed on the video monitor. In accordance with one embodiment, the device can be communicatively connected to one or more other similar devices and the monitor can be used to display interactive racing between the devices, which reflect the amount of work being performed on each individual device and measured against the others. Other exemplary uses of power created through the resistance-producing assembly 106 can include powering an audio device, charging electronic devices, such as cellular phones, powering a fan for cooling the user, powering lights, and many others.

Figure 2:
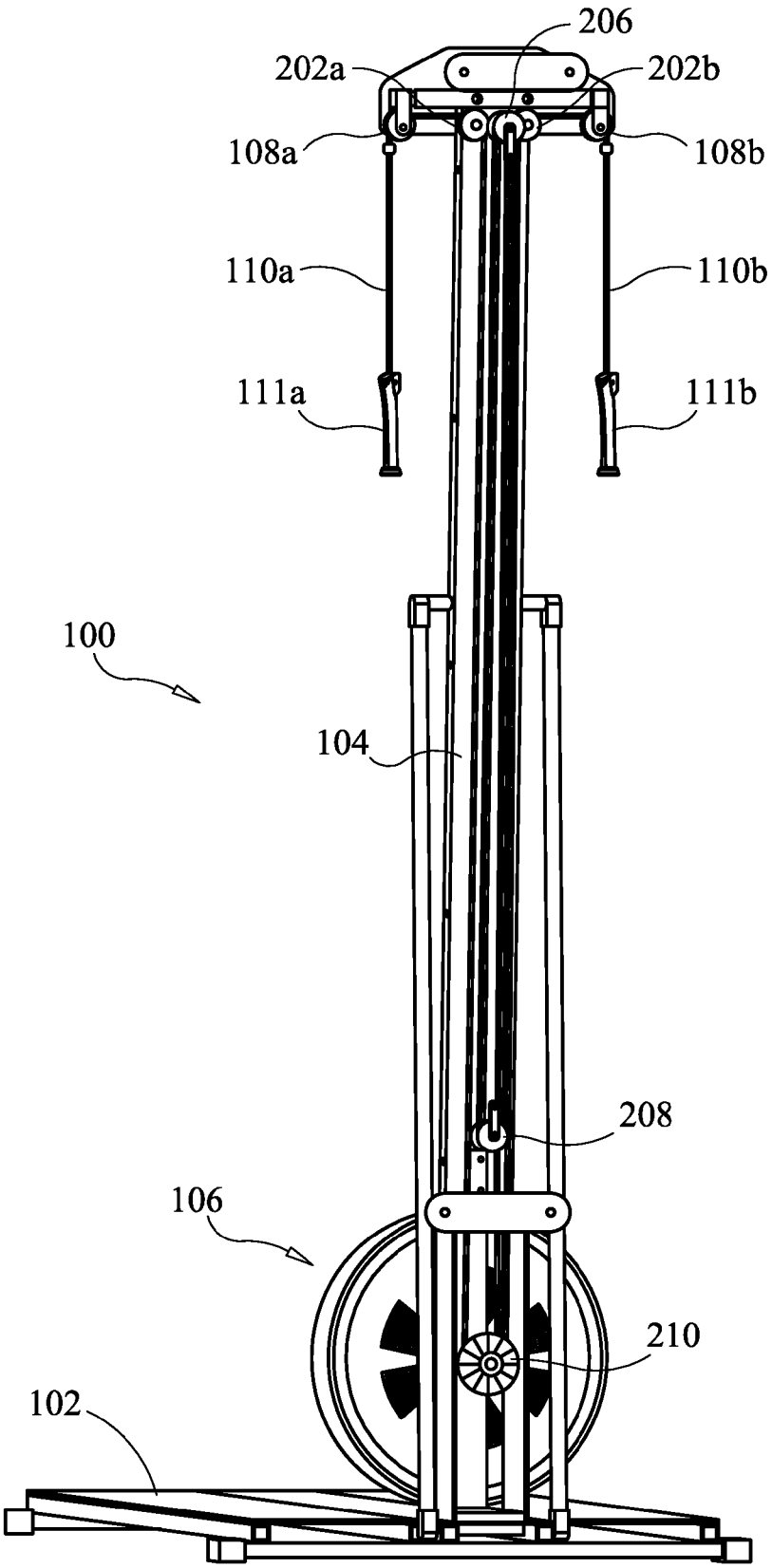
FIG. 2 is an elevational rear view of a ski-movement-simulation ergometer assembly in accordance with an embodiment of the present invention.

In addition, although FIG. 1 shows the platform 102 of the ski ergometer assembly 100 as being stationary and horizontal, the invention is in no way limited to such an embodiment.

In other embodiments, the platform 102 of the inventive ski ergometer assembly 100 rotates and/or pivots to simulate terrain encountered while performing actual skiing movements in nature. For instance, the platform 102 can automatically rotate when the user pulls one of the handles. The rotation would be in response to detecting the handle pull. The movement of the platform 102 would advantageously further exercise the user's legs and torso.

In other embodiments, the cables 110*a*, 110*b* are replaced with shafts that further mimic actual ski poles and that slide or telescope and cause the flywheel 1301 to rotate in a manner similar to that previously described for the cables. In still further examples, the shafts simulating ski poles are hingedly attached to the platform 102 and the user can alternately cause the poles to pivot at the base, the pivoting causing a resistance-producing device to apply resistance to the poles and simulate a ski move. This pivoting of the poles can accompany a movement of the platform 102 or portions of the base under the user's feet, either together or individually, to further simulate skiing.

An inventive ski-simulation ergometer assembly has just been described that allows a user to engage in a single pole or double pole exercise equally well. The inventive assembly provides a user-definable resistance to each cable attached to a pair of ski handles. Advantageously, the ski handles can be pulled in unison or separately to achieve the same benefit with no degradation in performance.

Figure 32:
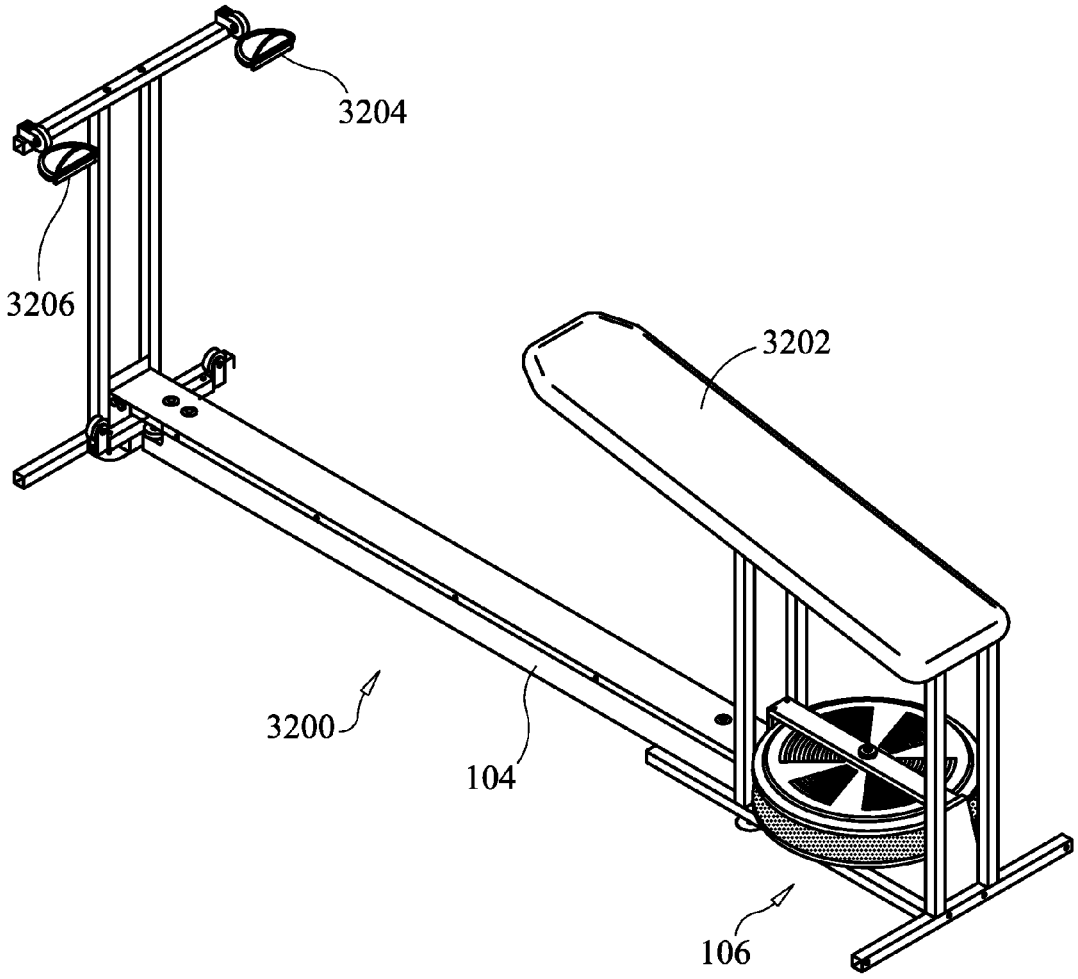
FIG. 32 shows a perspective view of a ski-movement-simulation ergometer used in conjunction with a support platform to simulate a swimming-type motion in accordance with the present invention.

FIG. 32 provides a perspective view of yet another novel use of the inventive device 3200. In this particular embodiment, the resistance device 3200 is in a horizontal position. A support bench 3202 is adjacent a portion of the resistance device 3200. A plane of the support bench 3202 is directed toward a set of handles 3204, 3206, which are spaced away from the elongated column 104 of the resistance device 3200. It is envisioned that the resistance device 3200, in conjunction with the support bench 3202, can be used to provide an exercise that simulates a swimming motion. More specifically, a user laying on the support bench 3202 and placing the handles 3204, 3206 in their hands can experience a resistance when their arms make a motion similar to a swimming stroke.

Advantageously, because the present invention is able to place resistance on both handles 3204, 3206 moved simultaneously or each handle, moved one at a time, the embodiment of the inventive device shown in FIG. 32 simulates alternate-arm strokes, such as freestyle or backstroke, just as well as it does simultaneous-arm strokes, such as the butterfly or breaststroke. To form the embodiment shown in FIG. 32, any of the assemblies shown in the previous figures can be provided with a hinge at their base that allows the assembly to simply pivot to the position of FIG. 32.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A ski-simulation assembly comprising:

a first ski-pole simulation handle;

a second ski-pole simulation handle; and a single cable defined by a first cable, a second cable, and a stretchable elastic cable, the stretchable elastic cable being fixedly connected to the first and second cables via non-spooling couplers, the single cable having a portion with a stretchable elastic property along its length and having a portion without a stretchable elastic property along its length;

a resistance-producing assembly physically coupled through the single cable to the first ski-pole simulation handle and physically coupled through the single cable to the second ski-pole simulation handle, the resistance-producing assembly operable to:

apply a selective resistance to the first ski-pole simulation handle independent of movement of the second ski-pole simulation handle; and apply a selective resistance to the second ski-pole simulation handle independent of movement of the first ski-pole simulation handle.

2. The ski-simulation assembly according to claim 1, wherein the resistance-producing assembly comprises:

a shaft;

a first engagement member rotationally coupled to the shaft in a first direction and rotationally disengaged with the shaft in a second direction that is opposite the first direction; and a second engagement member rotationally coupled to the shaft in the first direction and rotationally disengaged with the shaft in the second direction.

3. The ski-simulation assembly according to claim 2, wherein at least one of the engagement members comprises:

a clutch.

4. The ski-simulation assembly according to claim 2, wherein the resistance-producing assembly further comprises:

a flywheel coupled to the shaft.

5. A ski-simulation assembly comprising:

a vertical member having a first portion coupled to a base and a second portion extending upwardly from the base;

a first cable slidably engaged with the vertical member at the second portion of the vertical member;

a second cable slidably engaged with the vertical member at the second portion of the vertical member;

a stretchable elastic-type cable fixedly connected to the first cable at a first point of connection and axially aligned with the first cable at the first point of connection and fixedly connected to the second cable at a second point of connection and axially aligned with the second cable at the second point of connection; and a resistance-producing assembly physically coupled to the first cable, the stretchable elastic-type cable, and the second cable, the resistance-producing assembly operable to:

apply a selective resistance to the first cable independent of movement of the second cable; and apply a selective resistance to the second cable independent of movement of the first cable.

6. The ski-simulation assembly according to claim 5, further comprising:

a first arm coupled to and extending away from the second portion of the vertical member in a first direction; and a second arm coupled to and extending away from the second portion of the vertical member in a second direction substantially opposite the first direction.

7. The ski-simulation assembly according to claim 6, further comprising:

a first pulley coupled to a distal portion of the first arm; and a second pulley coupled to a distal portion of the second arm, wherein the first cable is slidably engaged with the first pulley and the second cable is slidably engaged with the second pulley.

8. The ski-simulation assembly according to claim 7, wherein the first arm further comprises:

a first portion; and a second portion slidably coupled to and selectively moveable with relation to the first portion of the first arm and operable to selectively adjust a distance between the first pulley and the second pulley.

9. The ski-simulation assembly according to claim 6, wherein:

the second portion is slidably coupled to and selectively moveable with relation to the first portion and operable to selectively adjust a distance between the first portion and the first and second arms.

10. The ski-simulation assembly according to claim 5, wherein the resistance-producing assembly comprises:

a shaft;

a first clutch rotationally coupled to the shaft in a first direction and rotationally disengaged with the shaft in a second direction that is opposite the first direction; and a second clutch rotationally coupled to the shaft in the first direction and rotationally disengaged with the shaft in the second direction.

11. The ski-simulation assembly according to claim 10, wherein the resistance-producing assembly further comprises:

a flywheel coupled to the shaft.

12. The ski-simulation assembly according to claim 5, further comprising:

a first ski-pole handle coupled to a proximal end of the first cable; and a second ski-pole handle coupled to a proximal end of the second cable.

13. A method of training for skiing, the method comprising:

providing a ski-simulation assembly including:

a vertical member having a first portion coupled to a base and a second portion extending upwardly from the base;

a first cable slidably engaged with the vertical member at the second portion of the vertical member;

a second cable slidably engaged with the vertical member at the second portion of the vertical member;

a stretchable elastic-type cable fixedly connected substantially end-to-end with the first cable and fixedly connected substantially end-to-end with the second cable to form a contiguous length of cable; and a resistance-producing assembly physically coupled to the first cable, the stretchable elastic-type cable, and the second cable, the resistance-producing assembly operable to:

apply a resistance to the first cable independent of movement of the second cable portion; and apply a resistance to the second cable independent of movement of the first cable;

grasping a handle coupled to the first cable of the ski-simulation assembly;

grasping a handle coupled to the second cable of the ski-simulation assembly; and alternatively pulling the first cable and the second cable to cause the resistance-producing assembly to move and generate a resistance in response to either cable being pulled individually.

14. The method according to claim 13, further comprising:

simultaneously pulling the first cable and the second cable to cause the resistance-producing assembly to move and generate a resistance in response to both cables being pulled together.

15. The method according to claim 13, wherein the ski-simulation assembly further comprises:

a first arm coupled to and extending away from the second portion of the vertical member in a first direction; and a second arm coupled to and extending away from the second portion of the vertical member in a second direction substantially opposite the first direction.

16. The method according to claim 15, wherein the ski-simulation assembly further comprises:

a first pulley coupled to a distal portion of the first arm; and a second pulley coupled to a distal portion of the second arm, wherein the first cable is slidably engaged with the first pulley and the second cable is slidably engaged with the second pulley.

17. The method according to claim 16, further comprising:

selectively securing, from a plurality of distance choices, a distance between the first pulley and the second pulley.

18. The method according to claim 17, wherein the selectively securing step comprises:

causing a first portion of the first arm to slide relative to a second portion of the first arm.

19. The method according to claim 13, wherein the resistance-producing assembly comprises:

a shaft;

a first clutch rotationally coupled to the shaft in a first direction and rotationally disengaged with the shaft in a second direction that is opposite the first direction; and a second clutch rotationally coupled to the shaft in the first direction and rotationally disengaged with the shaft in the second direction.

20. The method according to claim 19, wherein the resistance-producing assembly further comprises:

a flywheel coupled to the shaft.

* * * * *